US009889671B2

(12) United States Patent
Kimura et al.

(10) Patent No.: US 9,889,671 B2
(45) Date of Patent: Feb. 13, 2018

(54) LIQUID CONTAINER, LIQUID CONTAINER UNIT, AND LIQUID SUPPLY APPARATUS

(71) Applicant: SEIKO EPSON CORPORATION, Tokyo (JP)

(72) Inventors: Naomi Kimura, Okaya (JP); Shoma Kudo, Shiojiri (JP); Koji Nishimaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/066,736

(22) Filed: Mar. 10, 2016

(65) Prior Publication Data

US 2016/0263902 A1 Sep. 15, 2016

(30) Foreign Application Priority Data

Mar. 12, 2015 (JP) ..... 2015-049559

(51) Int. Cl.
*B41J 2/175* (2006.01)
*B41J 29/13* (2006.01)

(52) U.S. Cl.
CPC ..... *B41J 2/1752* (2013.01); *B41J 2/17509* (2013.01); *B41J 29/13* (2013.01)

(58) Field of Classification Search
CPC ..... B41J 2/1752; B41J 2/17509
See application file for complete search history.

(56) References Cited

U.S. PATENT DOCUMENTS

2008/0129777 A1* 6/2008 Watanabe ..... B41J 2/16523 347/36
2012/0182364 A1 7/2012 Takeda et al.
2012/0249628 A1* 10/2012 Katsuki ..... B41J 2/165 347/6
2014/0043408 A1* 2/2014 Kudo ..... B41J 2/175 347/86
2015/0109386 A1* 4/2015 Koike ..... B41J 2/17513 347/86

FOREIGN PATENT DOCUMENTS

JP 2012-144016 A 8/2012
JP 2014-054825 A 3/2014

* cited by examiner

*Primary Examiner* — Jason Uhlenhake
(74) *Attorney, Agent, or Firm* — Foley & Lardner LLP

(57) ABSTRACT

Provided is a technique capable of reducing the possibility that liquid reaches a visual check face. A liquid container includes a liquid retaining portion that can retain liquid and has an injection port forming face in which a liquid injection port is arranged, a visual check face that intersects the injection port forming face and through which a liquid surface in the liquid containing portion can be visually checked from the outside, and a container guiding path that guides the liquid existing in the injection port forming face in a direction different from a direction toward the visual check face.

19 Claims, 25 Drawing Sheets

LIQUID CONTAINER, LIQUID CONTAINER UNIT, AND LIQUID SUPPLY APPARATUS

Priority is claimed under 35 U.S.C. § 119 to Japanese Application No. 2015-049559 filed on Mar. 12, 2015 which is hereby incorporated by reference in its entirety.

BACKGROUND

1. Technical Field

The present invention relates to techniques regarding liquid containers that include liquid containing portion and a liquid injection port.

2. Related Art

In recent years, liquid containers having a liquid containing portion capable of containing liquid, and a liquid injection port for injecting the liquid into the liquid containing portion are known (e.g., JP-A-2014-54825 and JP-A-2012-144016). A user can inject the liquid into the liquid containing portion from the liquid injection port. The liquid containers disclosed in JP-A-2014-54825 and JP-A-2012-144016 have a visual check face through which a liquid surface in the liquid containing portion can be visually checked from the outside.

In the above technique, for example, the liquid outflows from a liquid injection portion, or the liquid erroneously drips around the liquid injection port when the liquid is injected from the liquid injection port into the liquid containing portion.

In the technique disclosed in JP-A-2014-54825, the liquid container is provided with an absorber that absorbs the liquid (i) around the liquid injection port, (ii) in a portion from the periphery of the liquid injection port up to the visual check face, or (iii) in a portion from the periphery of the liquid injection port up to a face that is different from the visual check face. This liquid container has an inclined face in which the liquid injection port is arranged and that inclines such that the side on which the visual check face is located is lower, and a projecting portion that dams up the liquid and is provided in a portion of the inclined face at the boundary between the inclined face and the visual check face.

For example, a vibration is applied to the liquid container, or the posture of the liquid container changes due to transportation of the liquid container in some cases. In such cases, there is concern that the liquid existing in the inclined face goes along a face of the liquid container other than portions in which the projecting portion and the absorber are arranged, and reaches the visual check face. In particular, there is concern that the liquid absorbed by the absorber leaks out and reaches the visual check face.

In the technique disclosed in JP-A-2012-144016, furthermore, a bottom face cover member that constitutes a bottom face in a liquid supply posture at the time of supplying the liquid to a liquid consuming apparatus is disclosed. This bottom face cover member has a groove-shaped liquid retaining portion for retaining the liquid. In the technique disclosed in JP-A-2012-144016, when in an injection state where the liquid is injected from the liquid injection port to the liquid containing portion, the visual check face is located below the liquid retaining portion. In this injection state, the bottom face cover member is erected with respect to an installation surface, and therefore, there is a possibility that the liquid existing in the liquid retaining portion flows to the visual check face side.

If the liquid is attached to the visual check face, it is difficult to visually check the liquid surface in the liquid containing portion from the outside via the visual check face in some cases. Accordingly, a technique capable of reducing the possibility of attachment of the liquid to the visual check face is desired. Also, a technique capable of reducing the possibility of attachment of the liquid to the periphery of the liquid container is desired. Also, regarding the known techniques, cost-reduction, resource-saving, simplification in manufacturing, improvement in usage, or the like are desired.

SUMMARY

The invention has been made in order to solve at least some of the foregoing problems, and can be achieved as the following modes or application examples.

(1) According to a mode of the invention, a liquid container having a liquid containing portion capable of containing liquid to be supplied to a liquid consuming apparatus, and a liquid injection port for injecting the liquid to the liquid containing portion is provided. This liquid container includes: a liquid retaining portion that can retain the liquid and has an injection port forming face in which the liquid injection port is arranged; a visual check face that intersects the injection port forming face and through which a liquid surface in the liquid containing portion can be visually checked from the outside; and a container guiding path that guides the liquid existing in the injection port forming face in a direction different from a direction toward the visual check face.

According to this mode, it is possible to suppress, using the container guiding path, a flow of the liquid existing in the injection port forming face toward the visual check face. Accordingly, the possibility that the liquid reaches the visual check face can be reduced.

(2) The liquid container according to the above mode may further include a suppressing portion that suppresses a flow of the liquid existing in the container guiding path toward the visual check face.

According to this mode, even if the liquid that has flowed out from the container guiding path flows toward the visual check face, the possibility that the liquid reaches the visual check face can be reduced by the suppressing portion. This configuration can reduce the possibility that the liquid is attached to the visual check face.

(3) The liquid container according to the above mode may further include a side wall that intersects the injection port forming face and the visual check face, wherein the container guiding path includes an opening portion formed in the side wall, and the suppressing portion includes a projecting portion that projects in a direction having a direction component parallel with the visual check face from a position between a portion of the side wall in which the opening portion is formed and a side portion in which the visual check face is located.

According to this mode, even if the liquid that has flowed through the opening portion flows toward the visual check face, the possibility that the liquid reaches the visual check face can be reduced by the projecting portion.

(4) In the liquid container according to the above mode, the projecting portion may constitute at least a part of the container guiding path.

According to this mode, a member for configuring the container guiding path and a member for configuring the suppressing portion can be formed using a common member.

(5) The liquid container according to the above mode may further include a visual check face forming wall that forms the visual check face, wherein the projecting portion is a face of the visual check face forming wall on a side opposite to the visual check face.

According to this mode, it is not necessary to form the projecting portion and the visual check face using different walls.

(6) According to another mode of the invention, a liquid container unit including: a liquid container having a liquid containing portion capable of containing liquid to be supplied to a liquid consuming apparatus, and a liquid injection port for injecting the liquid to the liquid containing portion; and a case that houses the liquid container is provided. The case of this liquid container unit has a lower case, and the lower case includes: a case recessed portion that is located within the case and is open on a side on which the liquid container is located, the case recessed portion being capable of storing the liquid, and a case guiding path forming portion for guiding the liquid to the case recessed portion, the case guiding path forming portion being located within the case and arranged at a position higher than a bottom face of the case recessed portion.

According to this mode, the liquid that has flowed to the inside of the lower case can be guided to the case recessed portion by the case guiding path forming portion.

(7) In the liquid container unit according to the above mode, the liquid container may include: a liquid retaining portion that can retain the liquid and has an injection port forming face in which the liquid injection port is arranged; a visual check face that intersects the injection port forming face and through which a liquid surface in the liquid containing portion can be visually checked from the outside; and a container guiding path that guides the liquid existing in the injection port forming face in a direction different from a direction toward the visual check face, and the container guiding path may be in communication with the case recessed portion.

According to this mode, since the container guiding path and the case recessed portion are in communication with each other, the liquid in the container guiding path can be caused to flow into the case recessed portion.

(8) In the liquid container unit according to the above mode, the lower case may further have a case guiding path forming wall that forms the case guiding path forming portion, and the case guiding path forming wall may have a holding portion that can be held and is formed in a portion on a side opposite to the case guiding path forming portion.

According to this mode, the case guiding path forming portion and the holding portion can be formed using the case guiding path forming wall.

(9) In the liquid container unit according to the above mode, the case may have an upper case, and the liquid container may be fixed to the upper case.

According to this mode, the liquid container can be fixed to the upper case.

(10) In the liquid container unit according to the above mode, the lower case may have a bottom face forming member that forms the bottom face of the case recessed portion, and the lower case may be arranged such that a face of the bottom face forming member on a side opposite to the bottom face of the case recessed portion faces an installation surface when in a use state where the liquid is supplied from the liquid container unit to the liquid consuming apparatus, and in an injection state where the liquid is injected from the liquid injection port to the liquid containing portion.

According to this mode, it is possible to reduce the possibility of an outflow of the liquid existing in the case recessed portion to the visual check face or the outside of the liquid container unit when in the use state and the injection state.

(11) In the liquid container unit according to the above mode, the case recessed portion may be in communication with a waste liquid storing portion provided in the liquid consuming apparatus for storing the liquid after being consumed.

According to this mode, it is possible to reduce the possibility of the overflow of the liquid that has flowed into the case recessed portion to the periphery.

(12) According to another mode of the invention, a liquid container having a liquid containing portion capable of containing liquid to be supplied to a liquid consuming apparatus, and a liquid injection port for injecting the liquid to the liquid containing portion is provided. This liquid container includes: a liquid retaining portion that can retain the liquid and has an injection port forming face in which the liquid injection port is arranged; a visual check face that intersects the injection port forming face and through which a liquid surface in the liquid containing portion can be visually checked from the outside; and a guiding path that guides the liquid existing in the injection port forming face in a direction different from a direction toward the visual check face, the guiding path being in communication with a waste liquid storing portion provided in the liquid consuming apparatus.

According to this mode, it is possible to reduce, using the guiding path, the possibility that the liquid existing in the injection port forming face reaches the visual check face. It is also possible to cause the liquid in the guiding path to flow into the waste liquid storing portion of the liquid consuming apparatus.

(13) According to another mode of the invention, a liquid supply apparatus having a plurality of liquid containers capable of containing liquid to be supplied to a liquid consuming apparatus is provided. The plurality of liquid containers of this liquid supply apparatus each include: a liquid containing portion capable of containing the liquid; a liquid supply port for supplying the liquid to the liquid containing portion; a liquid retaining portion that can retain the liquid and has a liquid supply port forming face in which the liquid supply port is arranged; and a visual check face that intersects the liquid supply port forming face and through which a liquid surface in the liquid containing portion can be visually checked from the outside, one of the plurality of liquid containers has the liquid containing portion whose volume is larger than a volume of the liquid containing portion of each of the other of the plurality of liquid containers, and the liquid retaining portion of the one of the plurality of liquid containers has a higher liquid retaining capability than a liquid retaining capability of the liquid retaining portion of each of the other of the plurality of liquid containers.

In general, more liquid is injected from the liquid supply port to the one of the liquid containers having a larger volume of the liquid containing portion than to the other of the liquid containers. Accordingly, when supplying the liquid, there is a possibility that more liquid scatters around the liquid supply port of the one of the liquid containers. According to this mode, since the liquid retaining portion of the one of the liquid containers has a higher liquid retaining capability than the liquid retaining capability of the liquid retaining portion of each of the other of the liquid containers, more liquid can be retained by the liquid retaining portion of the one of the liquid containers. This configuration can reduce the possibility that the liquid reaches the visual check face.

(14) In the liquid supply apparatus according to the above mode, the liquid retaining portion may include a recessed portion whose bottom face is the liquid supply port forming face.

According to this mode, the liquid can be retained by the recessed portion.

(15) In the liquid supply apparatus according to the above mode, the liquid retaining portion may include a liquid absorber.

According to this mode, the liquid can be retained by the liquid absorber.

(16) The liquid supply apparatus according to the above mode may further include a container guiding path that guides the liquid existing in the liquid supply port forming face in a direction different from a direction toward the visual check face.

According to this mode, it is possible to suppress a flow of the liquid existing in the liquid supply port forming face toward the visual check face. Accordingly, the possibility that the liquid reaches the visual check face can be further reduced.

Not all of the plurality of constituent elements that each of the above-described modes of the invention has are essential, and modification, deletion, replacement with other new constituent elements, and partial deletion of the limitation can be made as appropriate for some constituent elements in the plurality of constituent elements in order to solve some or all of the foregoing problems, or to achieve some or all of the effects described in the specification. It is also possible to combine some or all of the technical features included in one of the above-described modes of the invention with some or all of the technical features included in the other of the above-described modes of the invention to make an independent mode of the invention, in order to solve some or all of the foregoing problems, or to achieve some or all of the effects described in the specification.

For example, an apparatus according to a mode of the invention may be achieved as an apparatus including one or more of a plurality of elements that are the liquid retaining portion, the visual check face, and the container guiding path. That is to say, this apparatus may or may not have the liquid retaining portion. This apparatus may or may not have the visual check face. This apparatus may or may not have the container guiding path. For example, an apparatus according to another mode of the invention may be achieved as an apparatus including one or more of a plurality of elements that are the case recessed portion and the case guiding path forming portion. That is to say, this apparatus may or may not have the case recessed portion. This apparatus may or may not have the case guiding path forming portion. This apparatus may also be achieved as an apparatus including one or more of a plurality of elements that are the liquid containing portion, the liquid supply port, the liquid retaining portion, and the visual check face. That is to say, this apparatus may or may not have the liquid containing portion. This apparatus may or may not have the liquid supply port. This apparatus may or may not have the liquid retaining portion. This apparatus may or may not have the visual check face. According to these various modes, it is possible to solve at least one of various problems that are a reduction in the size of the apparatus, cost-reduction, resource-saving, simplification in manufacturing, improvement in usage, or the like. Any of some or all of the technical features in the respective modes of the above-described liquid container or liquid container unit can be applied to this apparatus.

Note that the invention can be achieved in various modes, and may be achieved not only as a liquid container and a liquid container unit, but also in modes such as a liquid consuming system including a liquid container and a liquid consuming apparatus and a liquid consuming system including a liquid container unit and a liquid consuming apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
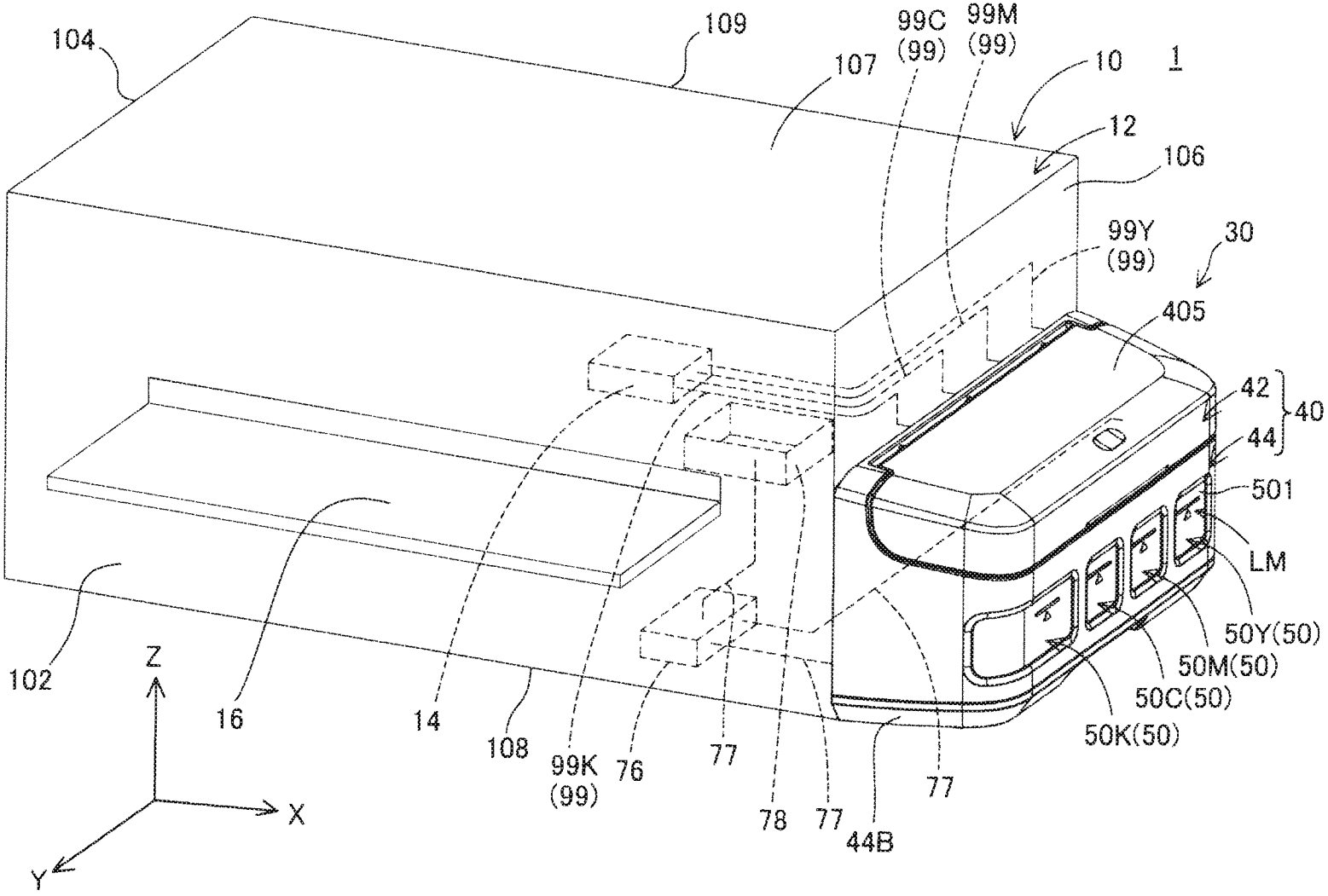
FIG. 1 is an external view of a liquid consuming system that serves as a first embodiment of the invention.

A-1. Description of Liquid Consuming System 1:

FIG. 1 is an external view of a liquid consuming system 1, which serves as a first embodiment of the invention. In FIG. 1, XYZ axes, which are orthogonal to one another, are indicated. Note that XYZ axes that correspond to those in FIG. 1 are also indicated in other diagrams as necessary.

The liquid consuming system (liquid ejection system) 1 includes a printer 10, which serves as a liquid consuming apparatus (liquid ejection apparatus), and a liquid container unit 30. When in a use state where the liquid consuming system 1 (liquid container unit 30) is used, the printer 10 and the liquid container unit 30 are installed on a horizontal surface that is defined by an X-axis direction and a Y-axis direction, That is to say, a Z-axis direction is a vertical direction (up-down direction). A −Z-axis direction is a vertically downward direction, and a +Z-axis direction is a vertically upward direction. The use state of the liquid consuming system 1 (liquid container unit 30) refers to a state where ink, which serves as liquid, can be supplied from the liquid container unit 30 to the printer 10.

The printer 10 is an inkjet printer. The printer 10 includes a recording head 14 that discharges the ink to a recording medium such as paper, a housing 12 that houses the recording head 14, and a waste liquid storing portion 76. The housing 12 has a substantially rectangular parallelepiped shape. The housing 12 includes a front face (first face, first wall) 102, a left side face (second face, second wall) 104, a right side face (third face, third wall) 106, an upper face (fourth face, fourth wall) 107, a bottom face (fifth face, fifth wall) 108, and a back face (sixth face, sixth wall) 109. The faces 102, 104, 106, 107, 108, and 109 constitute the housing 12, which is an outer shell of the printer 10. A discharge tray 16, to which a recording medium such as paper is discharged, is provided in the front face 102.

The front face 102 and the back face 109 oppose each other. The left side face 104 and the right side face 106 oppose each other. The front face 102, the back face 109, the left side face 104, and the right side face 106 are faces that are substantially perpendicular to a surface on which the printer 10 is installed. The upper face 107 and the bottom face 108 oppose each other. The upper face 107 and the bottom face 108 are faces that are substantially horizontal with respect to the surface on which the printer 10 is installed. The left side face 104 and the right side face 106 intersect the front face 102 and the back face 109. Here, being "substantially perpendicular" or being "substantially horizontal" means being almost "perpendicular" or "horizontal" as well as being completely "vertical" or "horizontal". That is to say, the faces 102, 104, 106, 107, 108, and 109 are faces that are not completely flat but include projections, recesses, or the like, and therefore, these faces need only be almost "perpendicular" or almost "horizontal" in the appearance.

A direction in which the left side face 104 and the right side face 106 oppose each other is the X-axis direction. A direction in which the front face 102 and the back face 109 oppose each other is the Y-axis direction. A direction in which the upper face 107 and the bottom face 108 oppose each other is the Z-axis direction. The X-axis direction is a "width direction" of the printer 10, the Y-axis direction is a "depth direction" of the printer 10, and the Z-axis direction is a "height direction" of the printer 10.

The recording head 14 is configured to be able to move in a main scanning direction (X-axis direction). Printing (recording) is performed on the recording medium as a result of the recording medium being conveyed in the Y-axis direction within the housing 12 and the ink being discharged from the recording head 14. Note that although in this embodiment, the recording head 14 is configured to be able to move in the main scanning direction, the invention is not limited thereto. For example, the recording head 14 may be a line head that extends in the X-axis direction and whose position is fixed.

The waste liquid storing portion 76 is arranged within the housing 12. The waste liquid storing portion 76 stores ink after being consumed. The waste liquid storing portion 76 is a container for collecting unused liquid (in this embodiment, ink that has not been used in printing). The waste liquid storing portion 76 is in communication with a flushing mechanism portion 78 that is used to remove a foreign matter (e.g., an air bubble) in a liquid discharge port of the recording head 14. Specifically, the waste liquid storing portion 76 and the flushing mechanism portion 78 are in communication with each other through a later-described communication path 77, which serves as a tube. The flushing mechanism portion 78 absorbs ink from the liquid discharge port of the recording head 14. The thus-absorbed ink is stored as ink (waste liquid) that has not been used in printing, in the waste liquid storing portion 76.

The liquid container unit 30 is attached to an outer wall face of the housing 12. In this embodiment, the liquid container unit 30 is attached to the right side face 106 of the housing 12. The liquid container unit (tank unit, liquid supply apparatus) 30 has a case 40, and a plurality of liquid containers 50K to 50Y that are arranged within the case 40. The plurality of liquid containers 50K to 50Y are arranged within the case 40 such that a part (a later-described visual check face 501 in which an upper limit portion LM is provided) thereof can be visually checked from the outside. With this configuration, the amount of ink (liquid surface of the ink) contained in the liquid containers 50K to 50Y can be visually checked from the outside of the case 40. The plurality of liquid containers 50K to 50Y are arranged in the Y-axis direction.

The case 40 has a case body 44 that houses the liquid containers 50K to 50Y, and a cover 42 that is attached to the case body 44 in an openable and closable manner. When the cover 42 is in a closed state, the cover 42 mainly constitutes an upper face of the case 40. The inside of the case 40 forms a space portion that contains the liquid containers 50. A detailed configuration of the case 40 will be described later.

A liquid container 50K contains black ink. A liquid container 50C contains cyan ink. A liquid container 50M contains magenta ink. A liquid container 50Y contains yellow ink. The plurality of liquid containers 50K to 50Y are in communication with the recording head 14 respectively through corresponding communication tubes (liquid supply tubes) 99K to 99Y. The ink contained in the plurality of liquid containers 50K to 50Y is supplied to the recording head 14 respectively through the corresponding liquid supply tubes 99K to 99Y by a supply mechanism (not shown), such as a pump, provided in the printer 10. Thus, the liquid supply tubes 99K to 99Y are used to connect the liquid containers 50K to 50Y to the printer 10 (specifically, the recording head 14) and supply the ink to the printer 10.

When referring to the plurality of liquid containers 50K to 50Y without distinction, a reference numeral "50" will be used. When referring to the plurality of liquid supply tubes 99K to 99Y that serve as communication tubes without distinction, a reference numeral "99" will be used. Note that although the number of liquid containers 50 is four, the number is not limited thereto. For example, the number of liquid containers 50 may be three or smaller, or may be five or larger. Although the liquid container unit 30 is attached to the right side face 106 of the housing 12, the liquid container unit 30 may be attached to other faces (e.g., left side face 104) of the housing 12.

Two communication paths 77 are provided in the liquid container unit 30. The communication paths 77 are in communication with the inside of a lower case 44B of the case 40. Note that details of the communication paths 77 and the case 40 will be described later.

Figure 2:
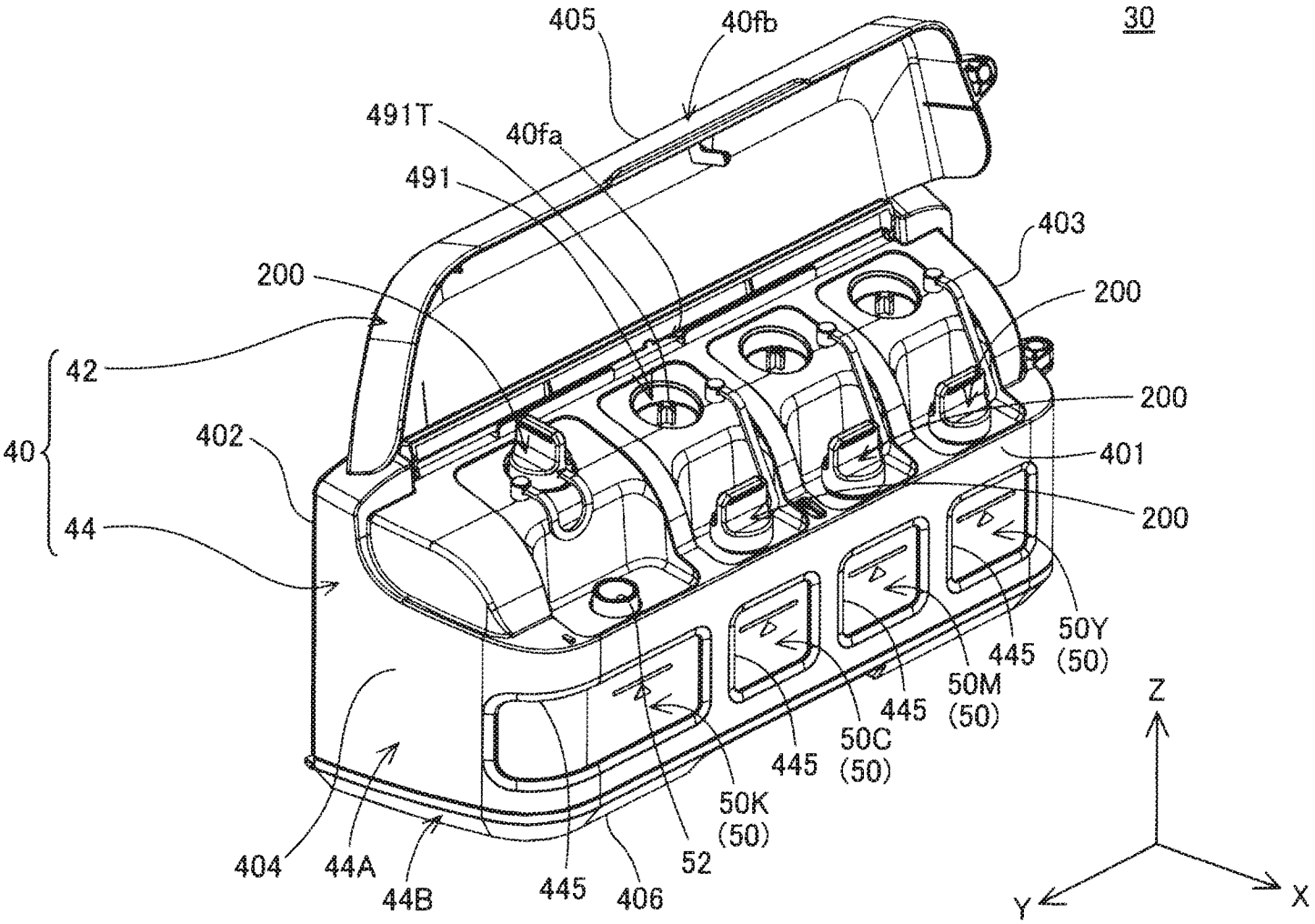
FIG. 2 is a perspective external view of a liquid container unit.

FIG. 2 is a perspective external view of the liquid container unit 30. In the liquid container 50K shown in FIG. 2, a plug member 200 has been removed from a liquid injection port (liquid supply port, liquid receiving port) 52. The liquid injection port 52 is open in the vertically upward direction when in the use state of the liquid container 50 (liquid container unit 30) when supplying the ink from the liquid container 50 to the recording head 14, and in the injection state of the liquid container 50 (liquid container unit 30) when injecting the ink from the liquid injection port 52 into the liquid container 50 (later-described liquid containing portion). The liquid injection port 52 is closed by the plug member 200 when in the use state. When injecting the ink into the liquid container 50, the user opens the cover 42 as shown in FIG. 2, and thereafter removes the plug member 200 from the liquid injection port 52. Then, the ink is injected from the liquid injection port 52 into the liquid container 50.

The case 40 has a substantially rectangular parallelepiped shape when in a closed state, as shown in FIG. 1. The case 40 has a first face 401 to a sixth face 406 that constitute an outer shell. A first face (case first wall, case front face) 401 and a second face (case second wall, case back face) 402 oppose each other. A third face (case third wall, case first side face) 403 and a fourth face (case fourth wall, case second side face) 404 oppose each other. In a state where the cover 42 is closed, a fifth face (case fifth wall, case upper face) 405 and a sixth face (case sixth wall, case bottom face) 406 oppose each other. In this embodiment, the first face 401 and the second face 402 oppose each other in the X-axis direction, the third face 403 and the fourth face 404 oppose each other in the Y-axis direction, and the fifth face 405 and the sixth face 406 oppose each other in the Z-axis direction. The first face 401 to the fourth face 404 are faces that are substantially perpendicular to the installation surface. The fifth face 405 constitutes an upper face of the case 40, and the sixth face 406 constitutes a bottom face of the case 40. The X-axis direction is a "depth direction" of the case 40, the Y-axis direction is a "width direction" of the case 40, and the Z-axis direction is a "height direction" of the case 40.

The first face 401 has visual check portions 445 that are configured such that upper limit portions LM can be visually checked from the outside. The visual check portions 445 are openings that are formed in the first face 401. Note that in another embodiment, the visual check portions 445 may not be by formed as openings, and the opening portions may be formed by transparent members or translucent members. The second face 402 is attached to the housing 12 (FIG. 1) by an attachment member such as a screw. In the second face 402, openings (not shown) are formed in order to arrange the liquid supply tubes 99 (FIG. 1). Thus, the second face 402 is a back face that faces the housing 12, and the first face 401 is a front face that opposes the back face 402 with a space for housing the liquid containers 50 therebetween.

The case body 44 houses the liquid containers 50 such that a part (upper end portion) of each liquid injection port 52 is located outside. Note that the case body 44 may contain the liquid container 50 such that a part (upper end portion) of each liquid injection port 52 is not located outside, and a part (upper end portion) of each liquid injection port 52 can be visually checked from the outside when in a state where the plug portion 200 for closing the liquid injection port 52 has been removed. The case body 44 mainly forms the first face 401 to the fourth face 404, and the sixth face 406. The case body 44 has an upper case 44A and the lower case 44B. The upper case 44A is located above the lower case 44B when in the use state and the injection state of the liquid container unit 30.

The upper case 44A mainly constitutes the first face 401, the second face 402, the third face 403, and the fourth face 404. The lower case 44B mainly constitutes the sixth face 406. That is to say, the lower case 44B is a bottom portion of the case body 44. The lower case 44B, which serves as the bottom portion of the case body 44 (case 40), is located below the liquid injection ports 52 and the visual check portions 445 in the vertical direction. The lower case 44B serving as the bottom portion also constitutes a bottom face of the case 40 that is in contact with the installation surface.

Figure 21:
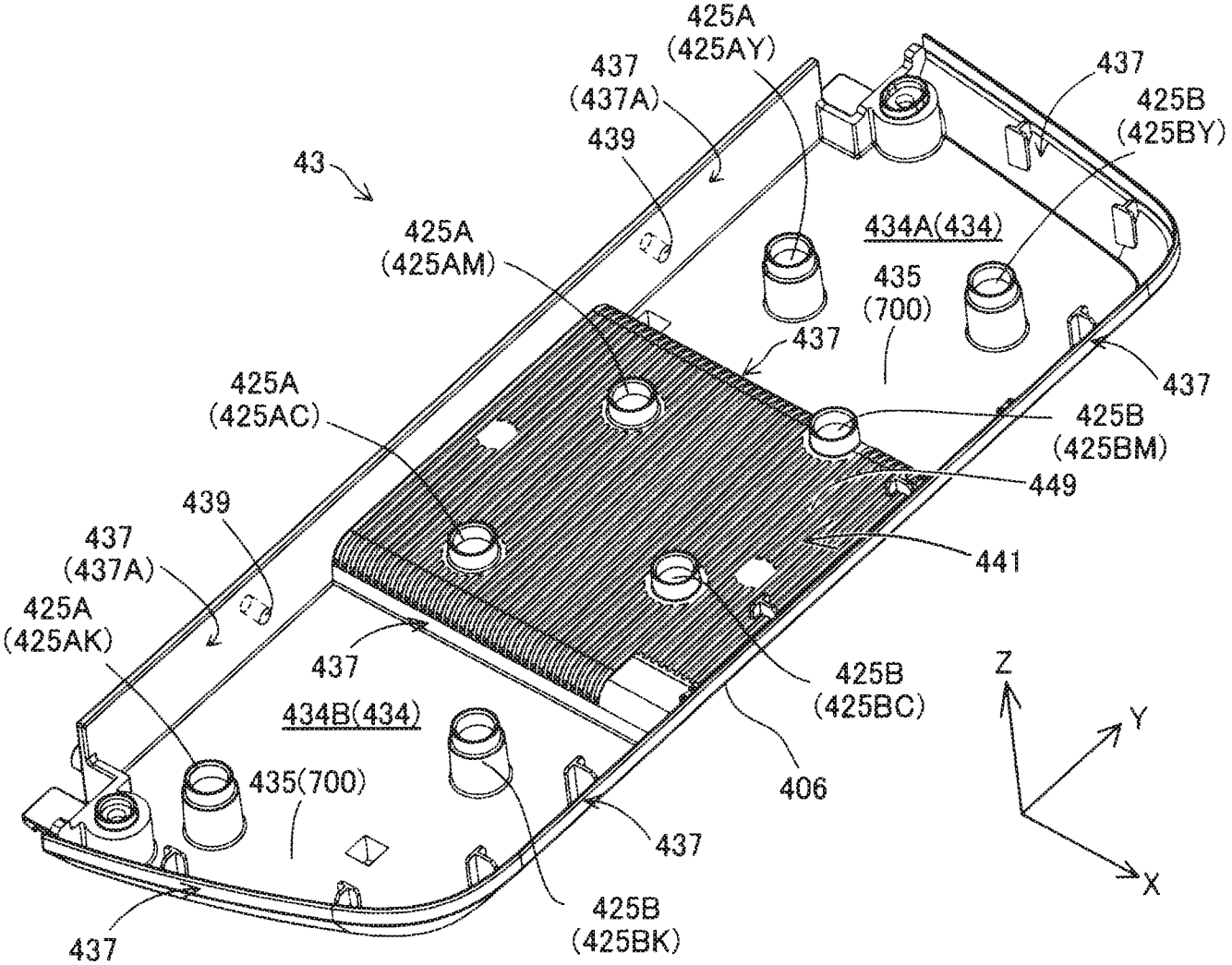
FIG. 21 is a perspective external view of a lower case.

Four plug member arrangement portions 491 for arranging the plug members 200 that have been removed from the liquid injection ports 52 are formed in a face of the case body 44 on the side in the +Z-axis direction. The plug member arrangement portions 491 each have a recessed portion and a protrusion 491T that projects from a bottom face of the recessed portion. The protrusion 491T is located at a position higher than a later-described case recessed portion 434 (FIG. 21) and a later-described case guiding path forming portion 441 (FIG. 21).

The cover 42 (FIG. 2) mainly forms the fifth face 405, which is an upper face. As shown in FIG. 2, the cover 42 has an axis-side end portion 40*fa*, which is an end portion on the second face 402 (housing 12 in FIG. 1) side, and a free end portion 40*fb*, which is an end portion on the first face 401 side. The cover 42 opens and closes as a result of the free end portion 40*fb* rotating around the axis-side end portion 40*fa*.

Figure 3:
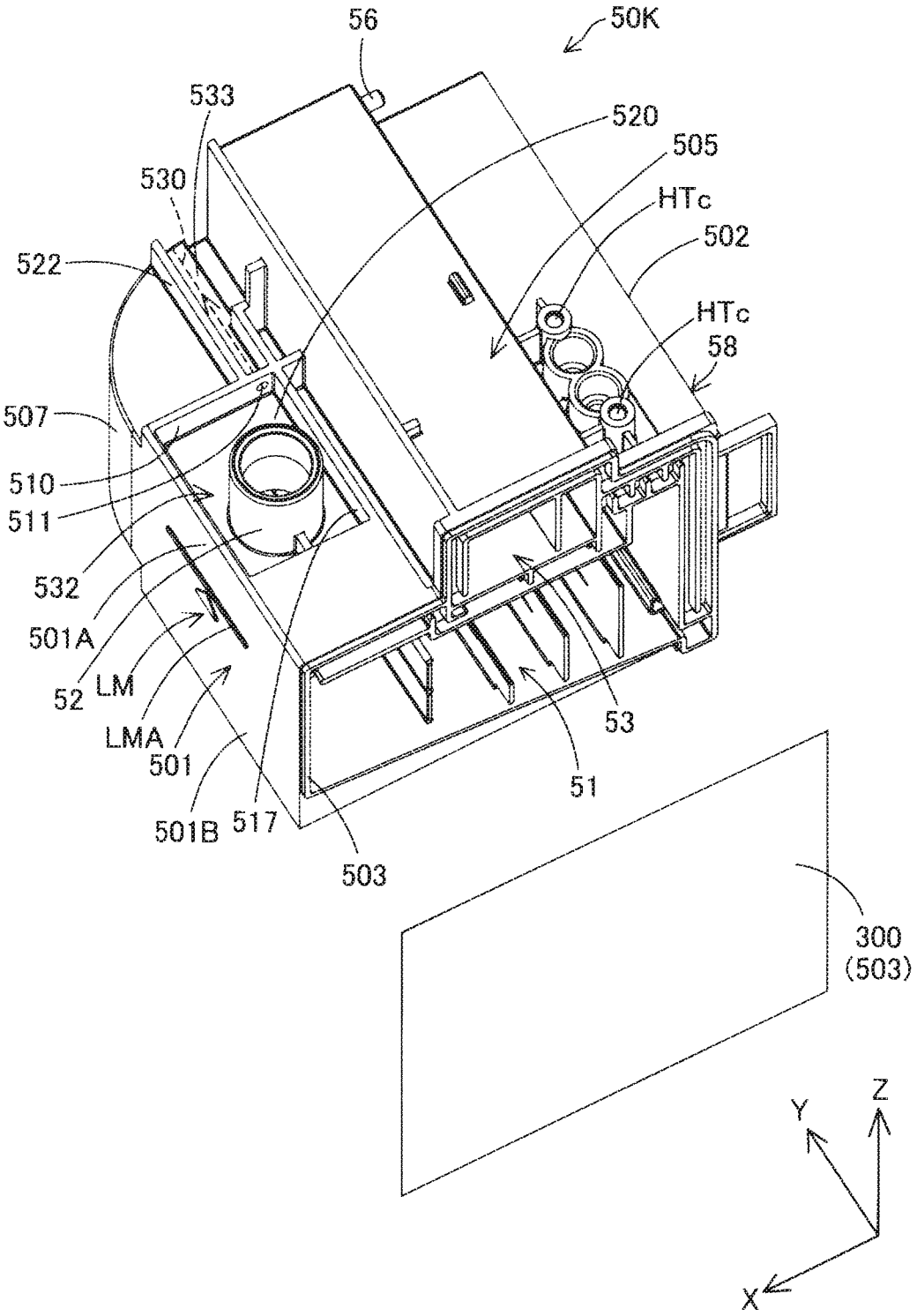
FIG. 3 is a perspective external view of a liquid container.
Figure 4:
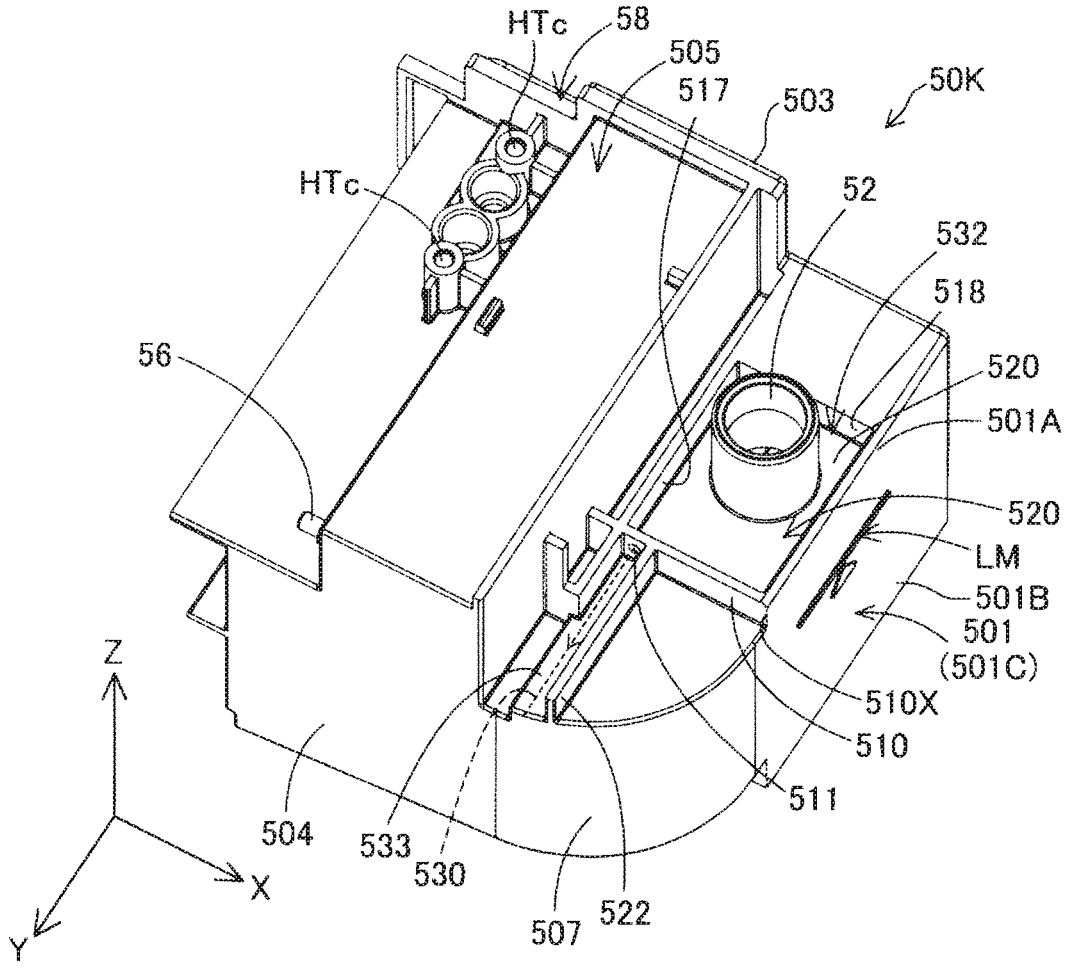
FIG. 4 is a perspective external view of the liquid container.
Figure 5:
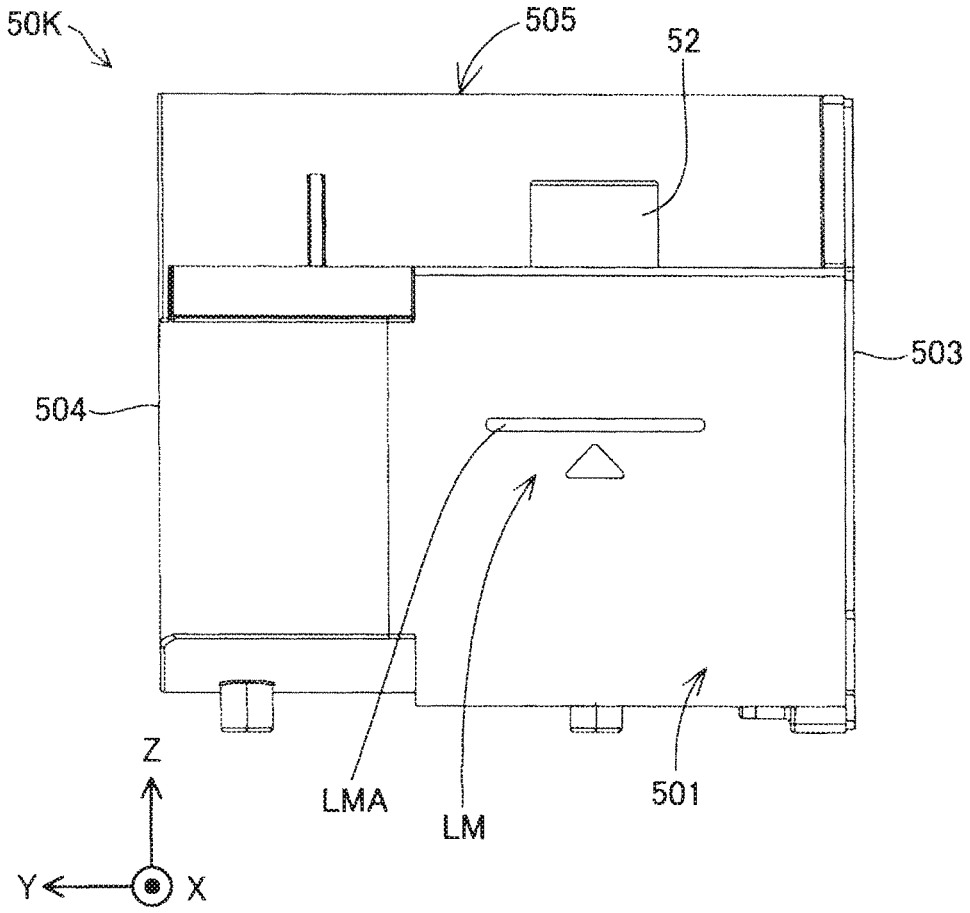
FIG. 5 is a front view of the liquid container.
Figure 6:
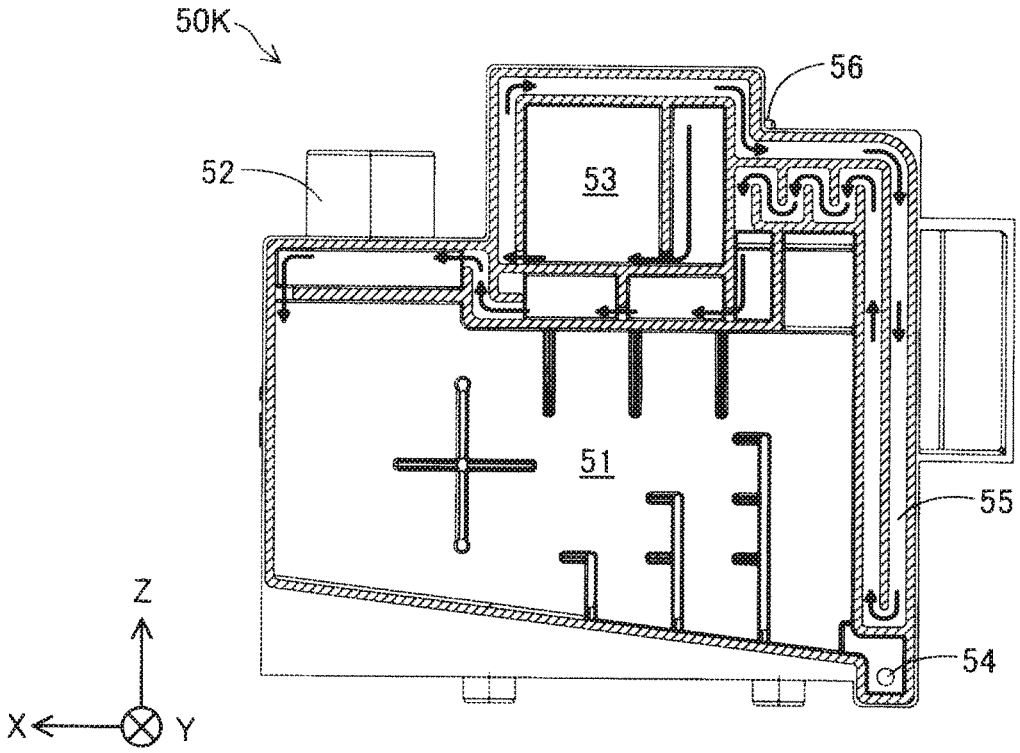
FIG. 6 is a right side view of the liquid container.
Figure 7:
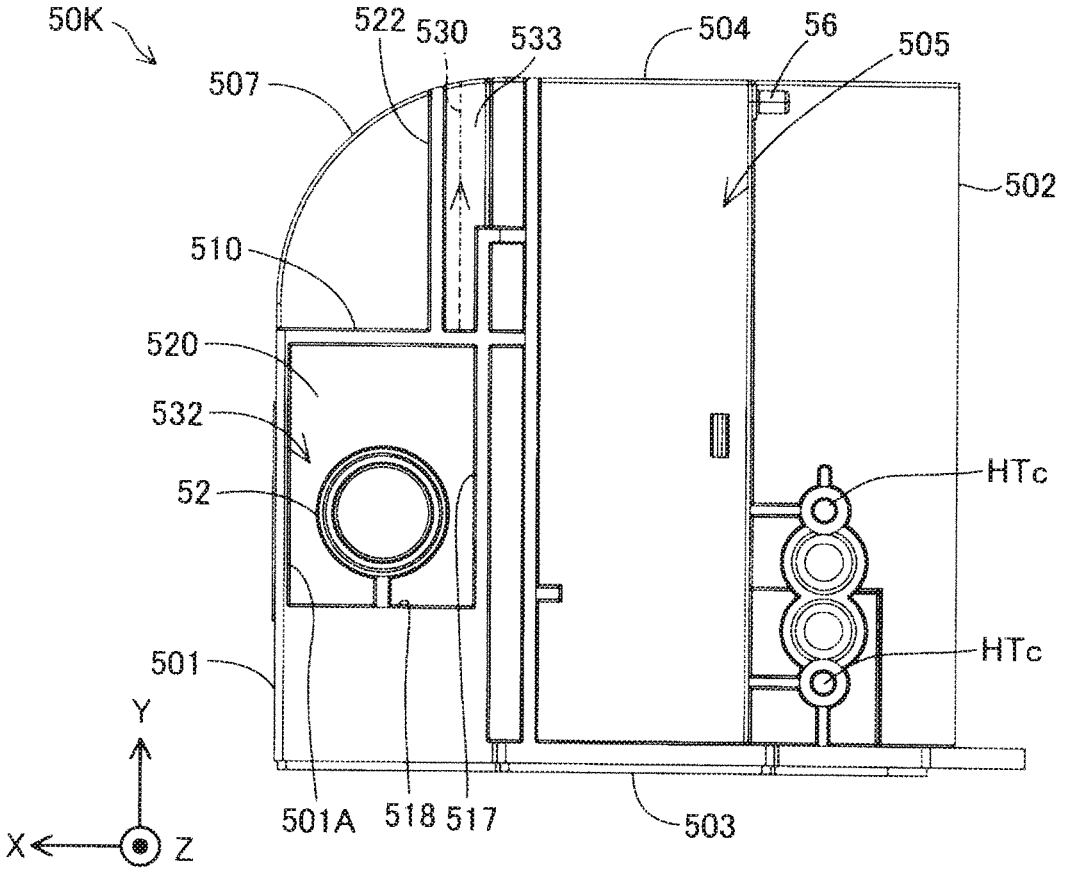
FIG. 7 is a top view of the liquid container.
Figure 8:
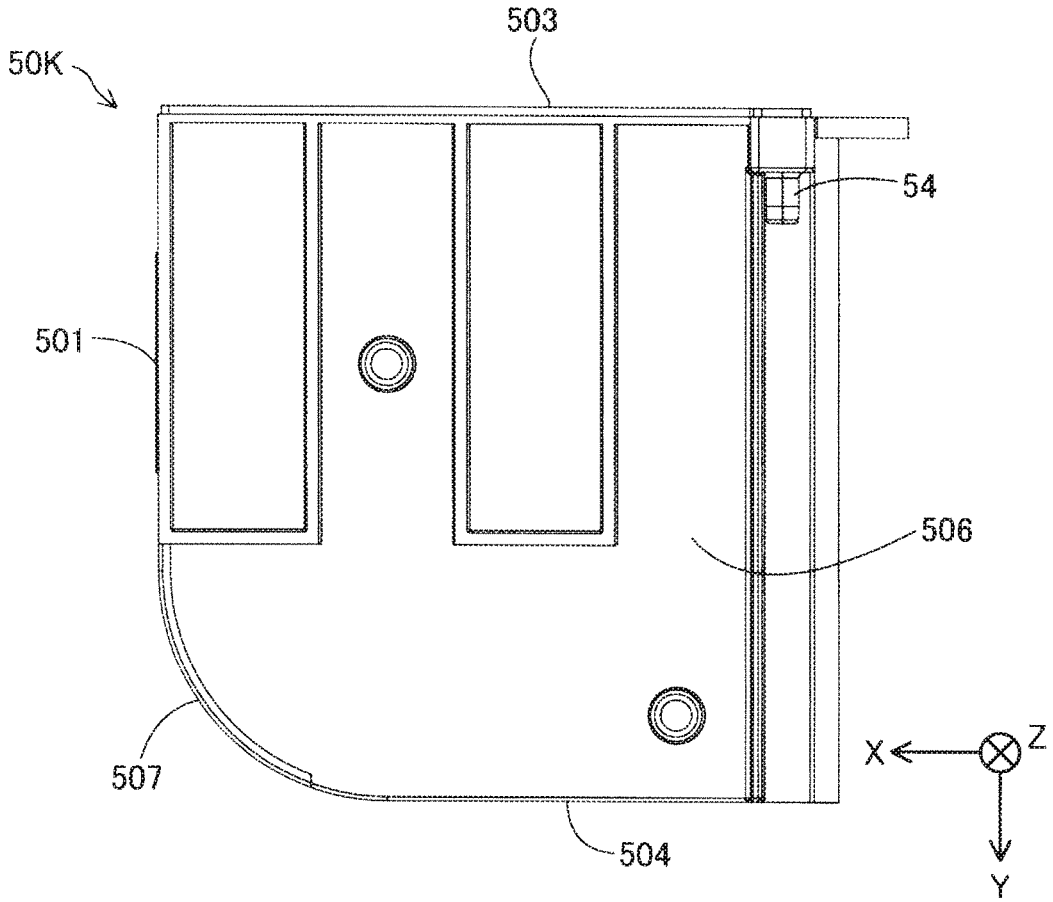
FIG. 8 is a bottom view of the liquid container.
Figure 9:
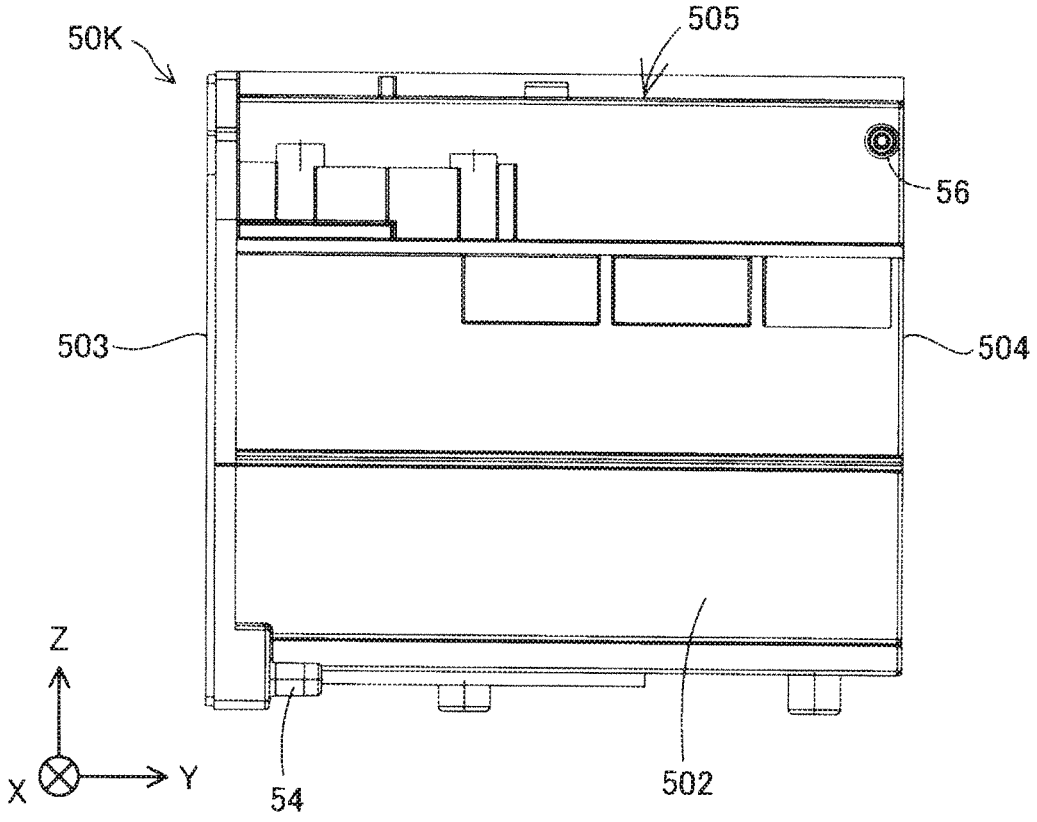
FIG. 9 is a back view of the liquid container.
Figure 10:
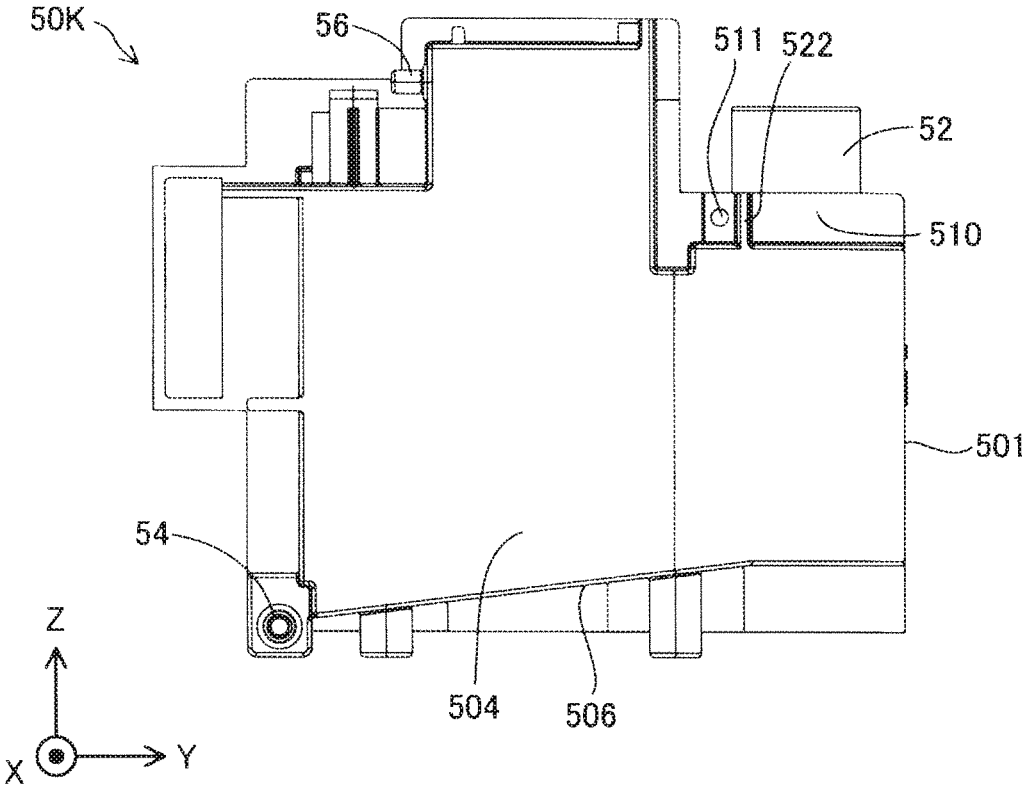
FIG. 10 is a left side view of the liquid container.

A-2. Detailed Configuration of Liquid Container 50:

FIG. 3 is a perspective external view of the liquid container 50K. FIG. 4 is a perspective external view of the liquid container 50K. FIG. 5 is a front view of the liquid container 50K. FIG. 6 is a right side view of the liquid container 50K. FIG. 7 is a top view of the liquid container 50K. FIG. 8 is a bottom view of the liquid container 50K. FIG. 9 is a back view of the liquid container 50K. FIG. 10 is a left side view of the liquid container 50K. The liquid container 50K that contains black ink will be described using FIGS. 3 to 10. Note that FIGS. 3 to 10 omit the plug member 200 (FIG. 2) that is detachably attached to the liquid injection port 52.

The liquid container 50K (FIG. 3) includes a liquid container body 58 in which the liquid injection port 52 is formed, and a film member 300. The liquid container body 58 has a recessed shape, i.e., is open on the third face 503 side, the third face 503 serving as a side face. The film member 300 is attached to the liquid container body 58 by means of adhesion or the like in an airtight manner so as to close the opening on the third face 503 side. Specifically, the film member 300 is attached in an airtight manner to a single-hatched portion in FIG. 6 in a side face of the liquid container body 58. Accordingly, the film member 300 forms the third face 503. An air chamber 53, an air communication path 55, and a liquid containing portion 51, which will be described later, are demarcated and formed by the liquid container body 58 and the film member 300.

The liquid container 50K includes the liquid containing portion 51 (FIG. 3), the liquid injection port 52 (FIG. 3), an air introduction port 56 (FIG. 3), and a liquid leading portion 54 (FIG. 8). The liquid containing portion 51 can contain ink that is to be supplied to the printer 10. The ink can be injected from the liquid injection port 52 to the liquid containing portion 51. The air can be introduced from the air introduction port 56 to the liquid containing portion 51 with consumption of the ink in the liquid containing portion 51. The liquid leading portion 54 can lead the ink to the outside (in this embodiment, to the printer 10). The liquid container 50K (FIG. 6) further has an air chamber 53 that is connected to the air introduction port 56, and an air communication path 55 that connects the air chamber 53 to the liquid containing portion 51. The air communication path 55 is a meandering flow path. With this configuration, a flow path length can be ensured in order to suppress evaporation of the ink in the liquid containing portion 51. Note that the air chamber 53 has a volume with which a predetermined amount of ink or more can be retained when the ink flows back toward the air introduction port 56. Note that in another embodiment, the air chamber 53 and the air communication path 55 may be omitted, and the air introduction port 56 may be directly connected to the liquid containing portion 51.

The liquid injection port 52 (FIG. 3) has a tubular shape. The liquid injection port 52 is connected to the liquid containing portion 51. The liquid leading portion 54 is in communication with the bottom portion of the liquid containing portion 51. The corresponding liquid supply tube 99 (FIG. 1) is connected to the liquid leading portion 54. The ink in the liquid containing portion 51 flows toward the recording head 14 through the liquid leading portion 54 and the liquid supply tube 99. With consumption of the ink in the liquid containing portion 51, the liquid surface of the ink in the liquid containing portion 51 lowers, and the air is introduced from the air introduction port 56 to the liquid containing portion 51.

The liquid container 50K (FIGS. 3, 4, and 8) has a plurality of faces (walls) 501 to 507 that constitute an outer shell. Specifically, the liquid container 50K has a first face (container first wall, container front face) 501, a second face (container second wall, container back face) 502, a third face (container third wall, container first side face) 503, a fourth face (container fourth wall, container second side face) 504, a fifth face (container fifth wall, container upper face) 505, a sixth face (container sixth wall, container bottom face) 506, and a connecting face (seventh face, container connecting wall) 507.

When in a first state of the liquid container 50K where the liquid injection port 52 is open in the vertically upward direction, the fifth face 505 is located above the liquid containing portion 51 (inside of the liquid container 50K). The sixth face 506 is located below the liquid containing portion 51 (inside of the liquid container 50K) when in the first state. The first face 501 and the second face 502 oppose each other. The third face 503 and the fourth face 504 oppose each other. The fifth face 505 and the sixth face 506 oppose each other. In this embodiment, the first face 501 and the second face 502 oppose each other in the X-axis direction, the third face 503 and the fourth face 504 oppose each other in the Y-axis direction, and the fifth face 505 and the sixth face 506 oppose each other in the Z-axis direction. The connecting face 507 (FIG. 4) is a curved face that connects the first face 501 and the fourth face 504, which are flat faces, to each other. The X-axis direction is a "depth direction" of the liquid container 50K, the Y-axis direction is a "width direction" of the liquid container 50K, and the Z-axis direction is a "height direction" of the liquid container 50K. The "first state" is the same state as the injection state and the use state of the liquid container 50.

The first face 501 is configured such that the liquid surface of the ink in the liquid containing portion 51 can be visually checked from the outside. In this embodiment, the first face 501 is formed by a transparent or translucent member, thereby allowing the liquid surface of the ink in the liquid containing portion 51 to be visually checked from the outside. Accordingly, the first face 501 will also be called a "visual check face 501".

The visual check face 501 (FIG. 4) intersects an injection port forming face (liquid supply port forming face) 520 in which the liquid injection port 52 is formed. In this embodiment, "to intersect" includes not only the case where two elements (e.g., faces) actually intersect each other, but also the case where an extended portion (e.g., an extended face) in the case of extending one element intersects the other element. In this embodiment, the visual check face 501 actually intersects the injection port forming face 520. The visual check face 501 intersects a side end portion of the injection port forming face 520 in the +X-axis direction. The visual check face 501 is a flat face that is substantially perpendicular when in the first state of the liquid container 50. When in the first state, the visual check face 501 has a first recessed portion forming wall (upper wall) 501A that is located above the injection port forming face 520, and a lower wall 501B that is located below the injection port forming face 520. The upper wall 501A extends from the injection port forming face 520 in a later-described container recessed portion 532, and forms a part of a wall that demarcates and forms the container recessed portion 532. The lower wall 501B is provided with the upper limit portion LM for identifying an upper limit of the ink that can be contained in the liquid containing portion 51. The upper limit portion LM has a horizontal line portion LMA. The user stops ink injection into the liquid containing portion 51 with the ink surface reaching the line portion as a guide.

The container recessed portion 532, which serves as a liquid retaining portion, is provided in the fifth face 505. The container recessed portion 532 is open in the vertically upward direction when in the first state. The container recessed portion 532 has an injection port forming face 520 that forms a bottom face of the container recessed portion 532, and first to fourth recessed portion forming walls 501A, 510, 517, and 518 that are erected from a peripheral portion of the injection port forming face 520 and demarcate and form a recessed shape.

The injection port forming face 520 constitutes a part of the fifth face 505. The liquid injection port 52 is arranged in the injection port forming face 520. The injection port forming face 520 is a substantially horizontal flat face when in the first state of the liquid container 50. As shown in FIG. 7, the outer shape of the injection port forming face 520 is substantially rectangular.

The first recessed portion forming wall 501A is a portion located above the injection port forming face 520 in a visual check face forming wall 501C that forms the visual check face 501 when in the first state. That is to say, the first recessed portion forming wall 501A is formed by a part of the visual check face forming wall 501C. Here, a face of the visual check face forming wall 501C on the side in the +X-axis direction is the visual check face 501.

A second recessed portion forming wall (side wall) 510, which serves as an opening portion forming wall, intersects the first recessed portion forming wall 501A (visual check face 501). A third recessed portion forming wall 518 intersects the first recessed portion forming wall 501A. The second and third recessed portion forming walls 510 and 518 oppose each other in the Y-axis direction. A fourth recessed portion forming wall 517 intersects the second and third recessed portion forming walls 510 and 518, and opposes the first recessed portion forming wall 501A in the X-axis direction. A later-described opening portion 511 is formed in the second recessed portion forming wall 510.

As a result of the liquid injection port 52 being arranged within the container recessed portion 532, the periphery of the liquid injection port 52 is surrounded by the plurality of walls 501A, 510, 517, and 518. With this configuration, the ink can be retained within the container recessed portion 532 when the ink leaks from the liquid injection port 52 or when the ink spills around the liquid injection port 52 when injecting the ink. A porous member (liquid absorber) such as a sponge may be arranged in the injection port forming face 520 of the container recessed portion 532. The liquid absorber may be arranged on the injection port forming face 520 while omitting the container recessed portion 532, or the liquid absorber may be arranged on the injection port forming face 520 of the container recessed portion 532. In this embodiment, at least one of the container recessed portion 532 and the liquid absorber corresponds to a "liquid retaining portion" for solving the problem.

As shown in FIGS. 3 and 4, the liquid container 50K has a container guiding path 530 that guides the ink existing in the injection port forming face 520 (within the container recessed portion 532) in a direction different from the direction (+X-axis direction) extending from the injection port forming face 520 toward the visual check face 501. In this embodiment, the container guiding path 530 guides the ink existing in the injection port forming face 520 in the direction (+Y-axis direction) extending from the third face 503 toward the fourth face 504. The container guiding path 530 is mainly demarcated and formed by the opening portion 511, a guiding path bottom face 533, which is a part of the fifth face 505, and a projecting portion (projecting wall) 522. The ink flowing through the container guiding path 530 reaches the connecting face 507. The ink that has reached the connecting face 507 flows on the connecting face 507 toward the sixth face (container bottom face) 506 side. Then, the ink reaches the case recessed portion of the later-described lower case 44B. When in the first state, the guiding path bottom face 533 is located below the injection port forming face 520 in the vertical direction.

The opening portion 511 is formed in the second recessed portion forming wall 510. The opening portion 511 is arranged near the injection port forming face 520 in the vertical direction in the first state. If a fixed amount of ink or more is stored in the injection port forming face 520 (container recessed portion 532), the ink flows to the outside of the container recessed portion 532 through the opening portion 511. The opening portion 511 forms an end (upstream end) of the container guiding path 530 in the flowing direction of the ink that flows through the container guiding path 530. The opening direction of the opening portion 511 that is open to the outside from the inside of the container recessed portion 532 is a direction that is different from the direction (+X-axis direction) extending from the injection port forming face 520 toward the visual check face 501. In this embodiment, the opening direction is the +Y-axis direction. That is to say, the opening direction intersects the direction (+X-axis direction) extending from the injection port forming face 520 toward the visual check face 501. Note that in another embodiment, it is preferable that the opening direction does not have a component of the direction (+X-axis direction) extending from the injection port forming face 520 toward the visual check face 501. In yet another embodiment, it is preferable that the visual check face 501 is not located in the opening direction. With this configuration, the ink existing in the injection port forming face 520 flows through the container guiding path 530, and the possibility that the ink reaches the visual check face 501 can be reduced.

A projecting portion 522 also functions as a suppressing portion that suppresses a flow of the ink existing in the container guiding path 530 toward the visual check face 501. The projecting portion 522 is erected from the guiding path bottom face 533. The projecting portion 522 extends from the second recessed portion forming wall 510 up to the connecting face 507. The projecting portion 522 projects in a direction having a direction component that is parallel with the visual check face 501 from a position between a portion of the second recessed portion forming wall (opening portion forming wall, side wall) 510 in which the opening portion 511 is formed and a side portion (visual check face side portion) 510X (FIG. 4) in which the visual check face 501 is located. In this embodiment, the projecting portion 522 projects in the direction (Y-axis direction) that is parallel with the visual check face 501.

As shown in FIGS. 3 and 4, the liquid container 50K has attachment holes HTc that are provided in the fifth face 505. The attachment holes HTc are used to fix the liquid container 50K to the upper case 44A.

Figure 11:
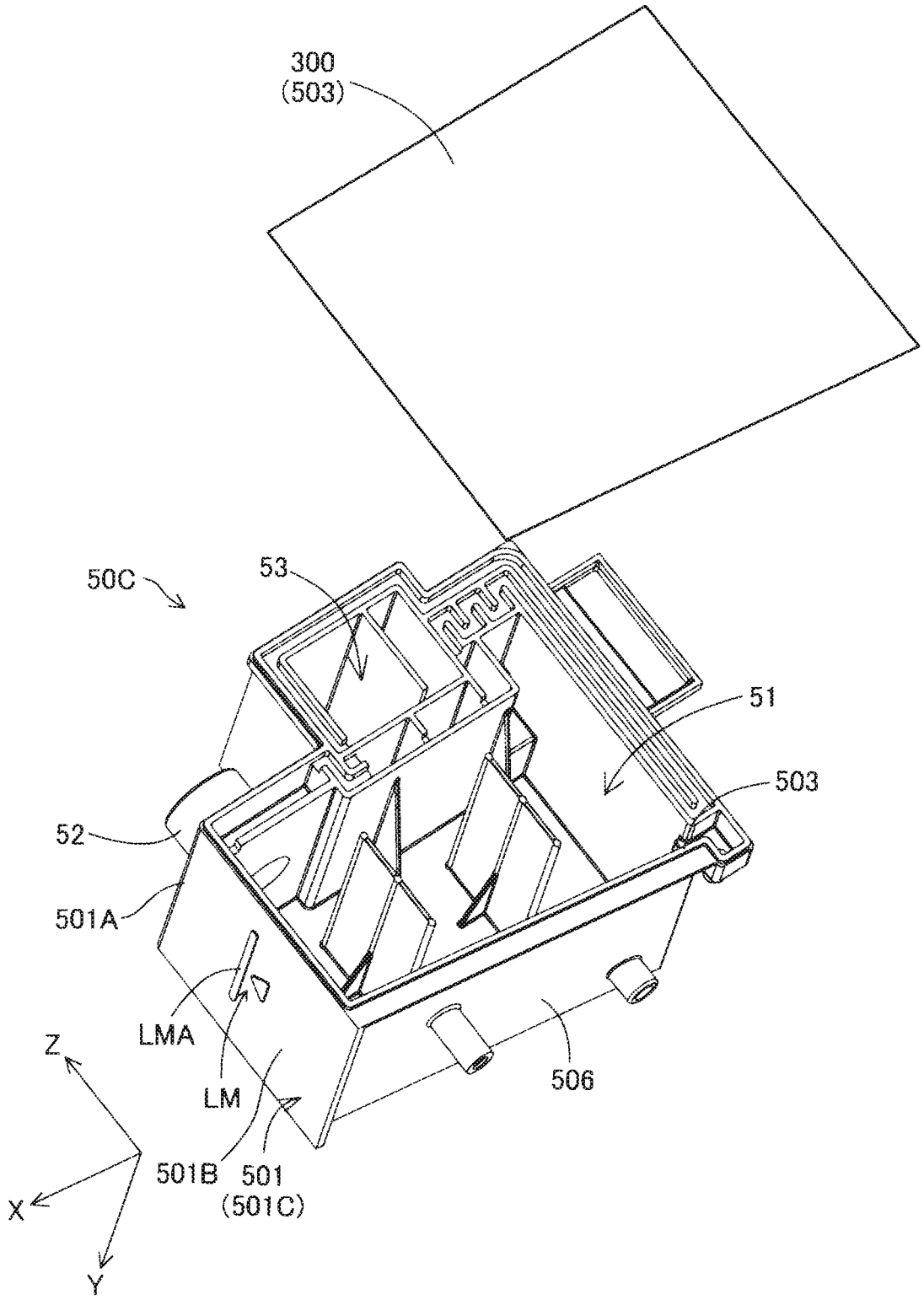
FIG. 11 is a perspective external view of the liquid container.
Figure 12:
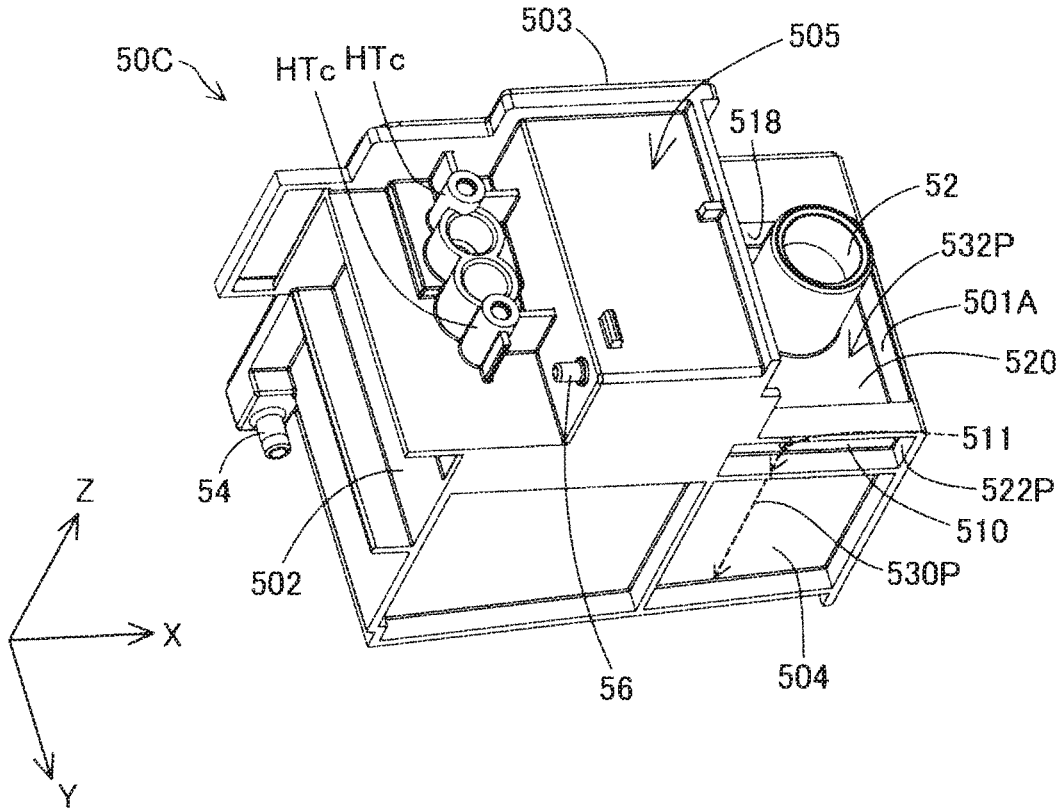
FIG. 12 is a perspective external view of the liquid container.
Figure 13:
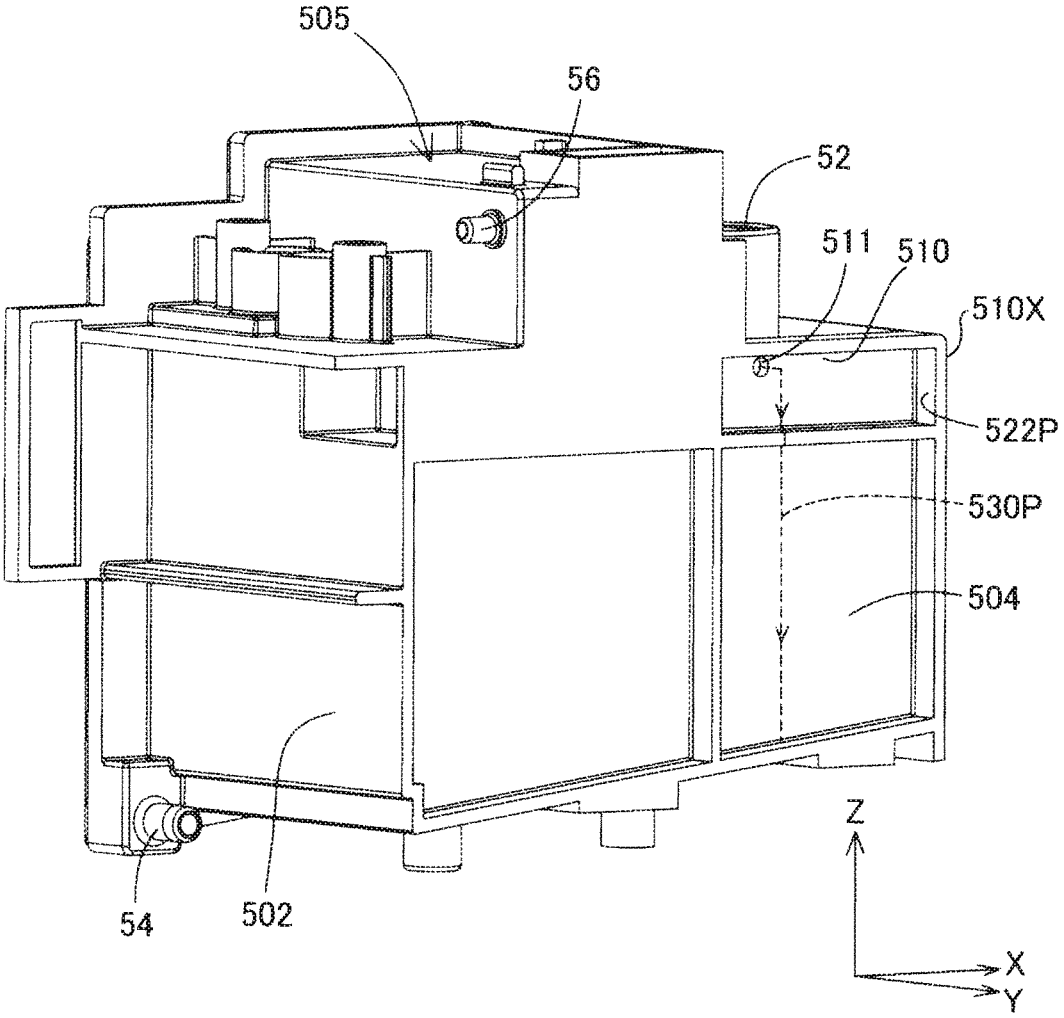
FIG. 13 is a perspective external view of the liquid container.
Figure 14:
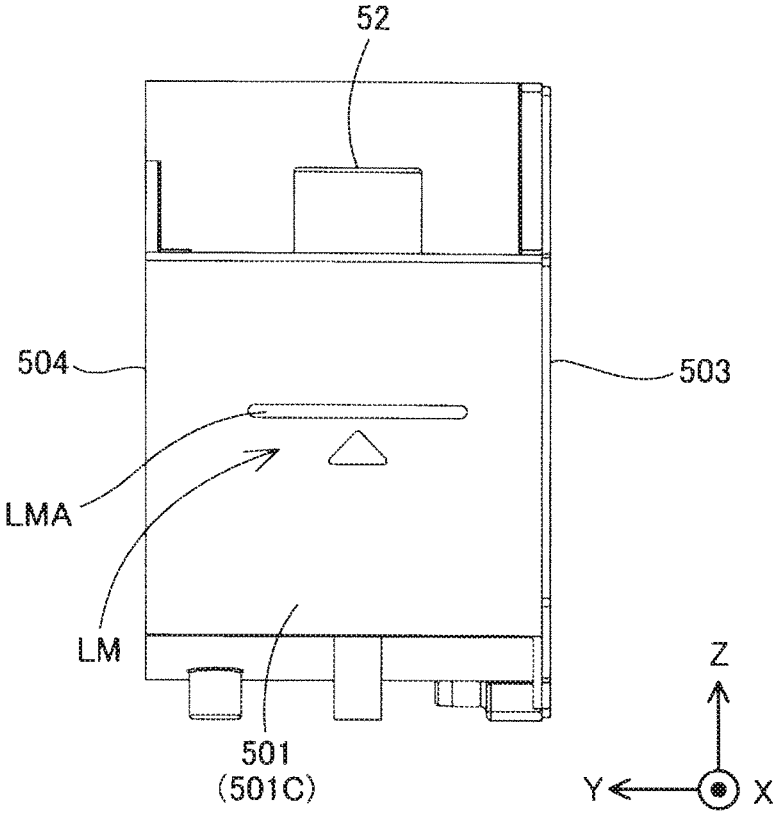
FIG. 14 is a front view of the liquid container.
Figure 15:
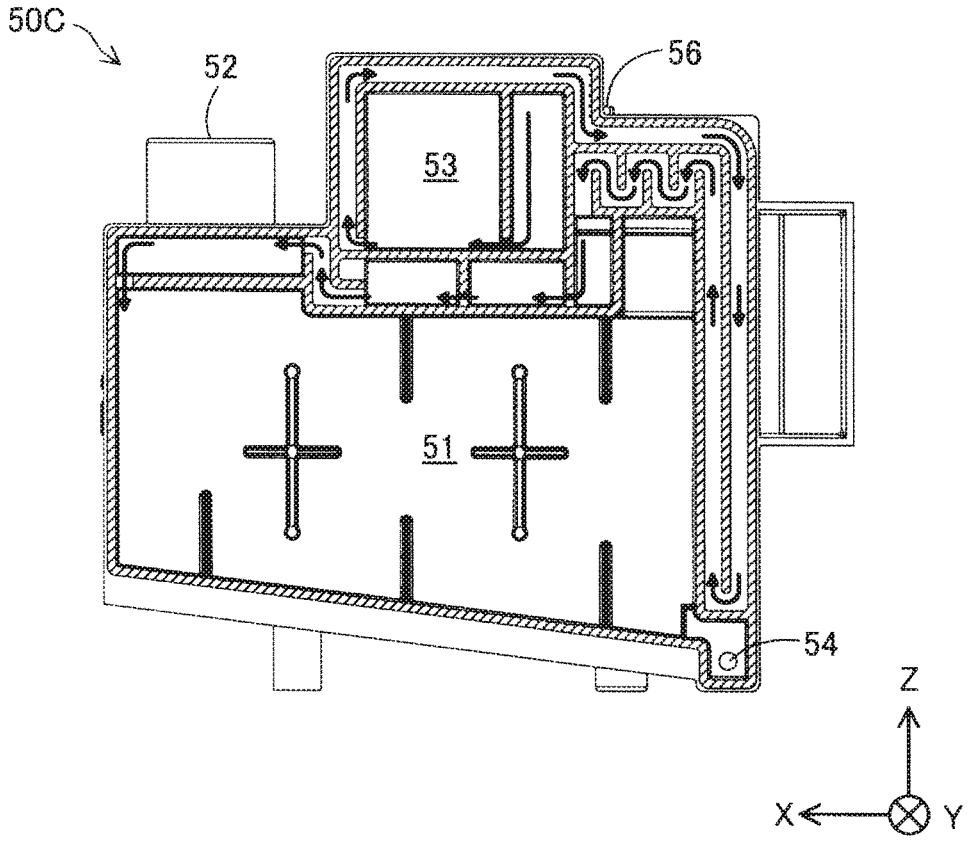
FIG. 15 is a right side view of the liquid container.
Figure 16:
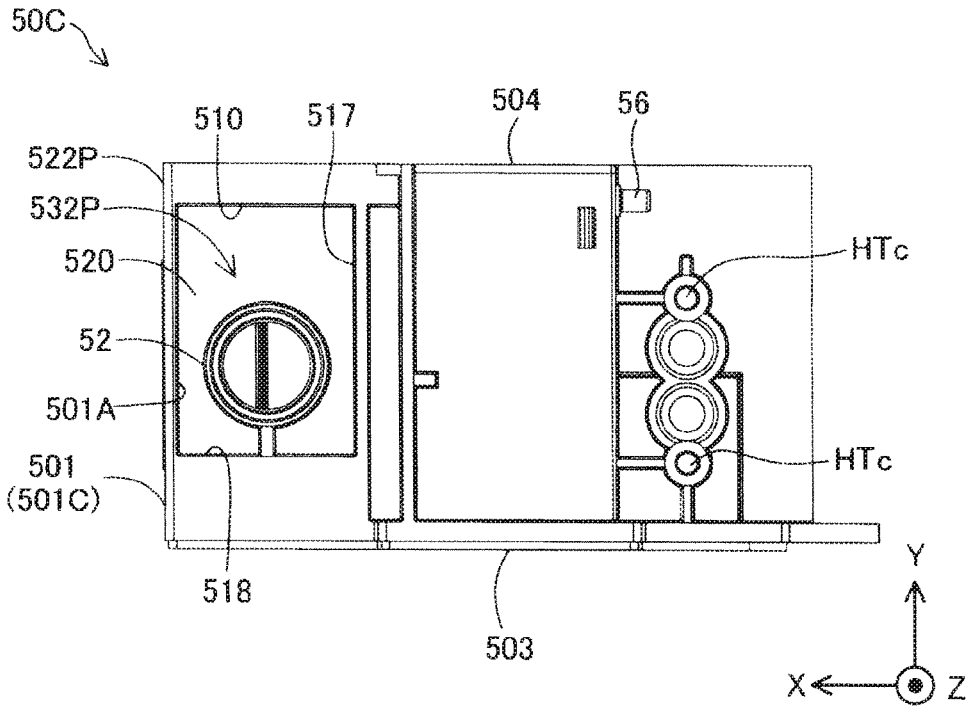
FIG. 16 is a top view of the liquid container.
Figure 17:
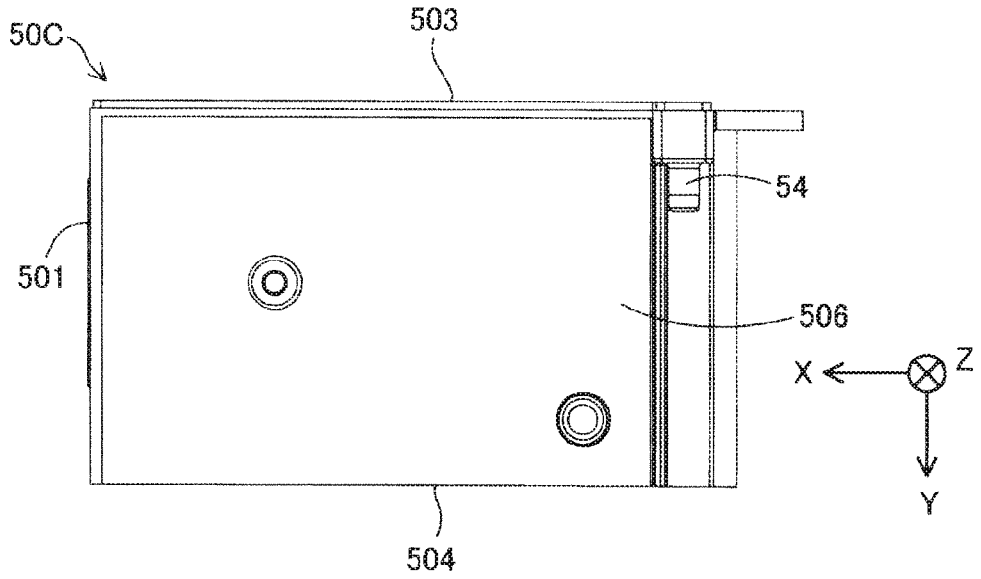
FIG. 17 is a bottom view of the liquid container.
Figure 18:
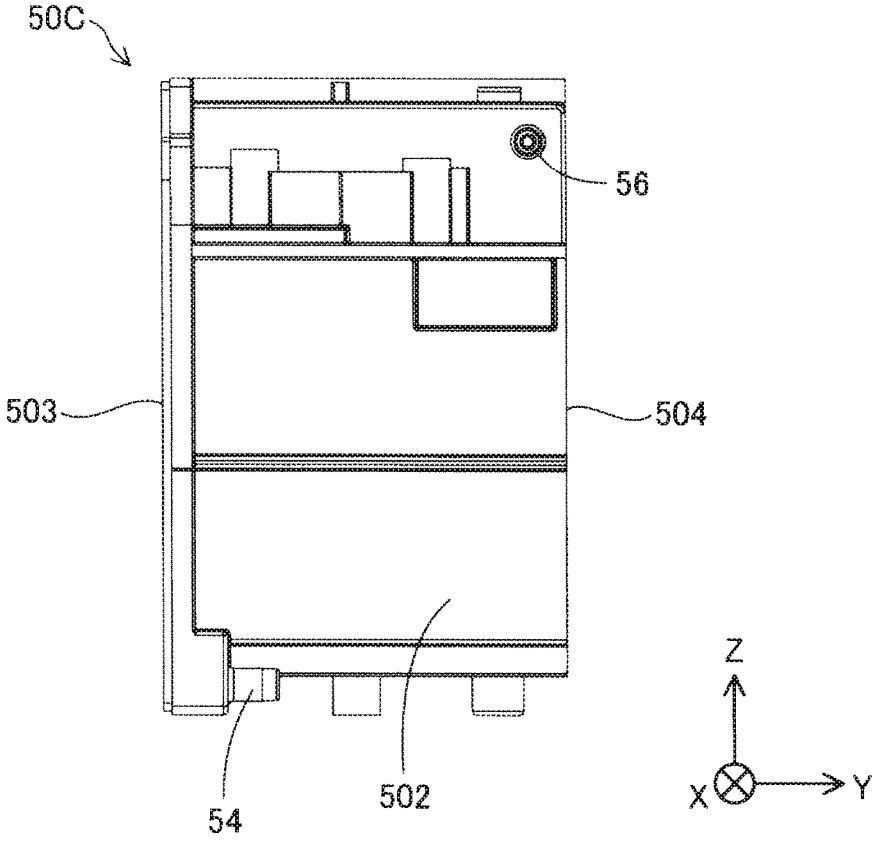
FIG. 18 is a back view of the liquid container.
Figure 19:
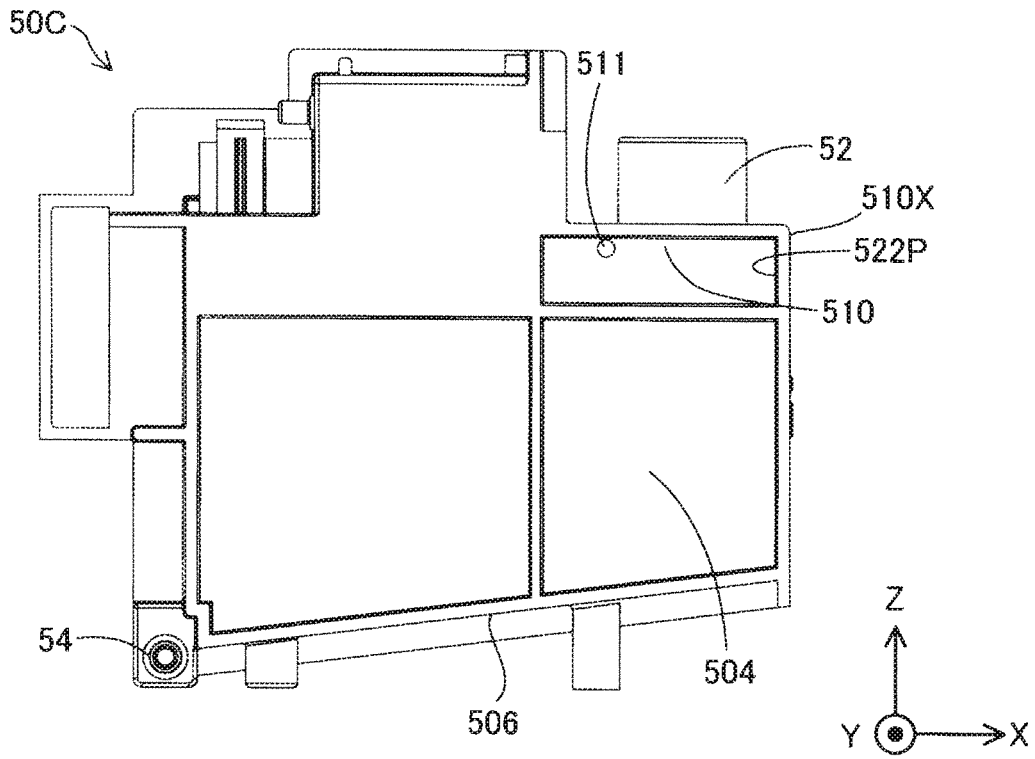
FIG. 19 is a left side view of the liquid container.

FIG. 11 is a perspective external view of the liquid container 50C. FIG. 12 is a perspective external view of the liquid container 50C. FIG. 13 is a perspective external view of the liquid container 50C. FIG. 14 is a front view of the liquid container 50C. FIG. 15 is a right side view of the liquid container 50C. FIG. 16 is a top view of the liquid container 50C. FIG. 17 is a bottom view of the liquid container 50C. FIG. 18 is a back view of the liquid container 50C. FIG. 19 is a left side view of the liquid container 50C. Since the liquid containers 50C, 50M, and 50Y have the same configuration, the liquid container 50C will be described below. Note that FIGS. 11 to 18 omit the plug member 200 (FIG. 2) that is detachably attached to the liquid injection port 52. Differences between the liquid container 50K that contains black ink and the liquid containers 50C, 50M, and 50Y that contains cyan, magenta, and yellow ink mainly lie in that the liquid containers 50C, 50M, and 50Y do not have the connecting face 507, as well as in the configuration of a container guiding path 530P and the configuration of a projecting portion 522P. Since other configurations are similar between the liquid container 50K and the liquid containers 50C, 50M, and 50Y, the similar configurations will be assigned the same reference numerals, and descriptions thereof will be omitted as appropriate.

The liquid container 50C has a plurality of faces (walls) 501 to 506 that constitute an outer shell. The liquid container 50C does not have the connecting face 507 (FIG. 4), and the visual check face 501 is directly connected to the fourth face 504 as shown in FIG. 19.

As shown in FIG. 12, a container recessed portion 532P, which serves as a liquid retaining portion, is formed in the fifth face 505 of the liquid container 50C, as in the liquid container 50K. As shown in FIG. 19, a second recessed portion forming wall (opening portion forming wall) 510 of the container recessed portion 532P is formed by a part (upper part) of the fourth face 504, unlike in the liquid container 50K.

As shown in FIG. 13, the liquid container 50C has a projecting portion 522P that projects from the fourth face 504 (second recessed portion forming wall 510). As shown in FIGS. 13 and 19, the projecting portion 522P is a face on the side opposite to the visual check face 501 serving as a first face of the visual check face forming wall 501C. The projecting portion 522P is a face projecting in a direction having a direction component that is parallel with the visual check face 501 from a position between a portion of the second recessed portion forming wall (opening portion forming wall, side wall) 510 in which an opening portion 511 is formed and a side portion 510X (FIG. 13) in which the visual check face 501 is located. In this embodiment, the projecting portion 522P projects in the direction (Y-axis direction) that is parallel with the visual check face 501. The projecting portion 522P is formed from an upper end up to a lower end of the fourth face 504 in the first state. The projecting portion 522P also functions as a suppressing portion that suppresses a flow of the ink existing in the container guiding path 530 toward the visual check face 501, as the projecting portion 522 does.

The container guiding path 530P guides the ink existing in the injection port forming face 520 (within the container recessed portion 532) in a direction different from the direction (+X-axis direction) extending from the injection port forming face 520 toward the visual check face 501. The container guiding path 530P is mainly demarcated and formed by the opening portion 511, the fourth face 504, and the projecting portion 522P. As shown in FIG. 13, the ink flowing through the container guiding path 530P flows from the opening portion 511 toward the sixth face (container bottom face) 506 side. Then, the ink reaches the case recessed portion of the later-described lower case 44B.

A-3. Regarding Liquid Retaining Portions of Liquid Containers 50K, 50C, 50M, and 50Y In the liquid container 50K serving as one of the liquid containers, the liquid containing portion 51 has a larger volume than that in each of the liquid containers 50C, 50M, and 50Y serving as the other of the liquid containers. With this configuration, the liquid container 50K can contain more of ink than each of the liquid containers 50C, 50M, and 50Y does. On the other hand, it may be necessary in the liquid container 50K to inject more ink from the liquid injection port 52 to the liquid containing portion 51 than in each of the liquid containers 50C, 50M, and 50Y.

The container recessed portion 532 (FIG. 4) of the liquid container 50K has a higher liquid retaining capability than the liquid retaining capability of the container recessed portion 532P (FIG. 12) of each of the liquid containers 50C, 50M, and 50Y. Here, the "liquid retaining capability" is expressed by the amount of ink that can be retained. The higher the liquid retaining capability is, more liquid can be retained. In this embodiment, the container recessed portion 532 is configured to be able to retain more ink than each container recessed portion 532P does. That is to say, the container recessed portion 532 has a larger volume than the volume of each container recessed portion 532P. In this embodiment, the area of the injection port forming face 520 of the container recessed portion 532 is set larger than the area of the injection port forming face 520 of the container recessed portion 532P, thereby achieving a relationship in which the volume of the container recessed portion 532 is larger than the volume of the container recessed portion 532P.

With this configuration, the container recessed portion 532 of the liquid container 50K has a higher liquid retaining capability than the liquid retaining capability of the container recessed portion 532 of each of the other of liquid containers 50C, 50M, and 50Y, and therefore, more ink can be retained in the container recessed portion 532 in the liquid container 50K in which more ink is likely to scatter around the liquid injection port 52. Thus, the possibility that the ink reaches the visual check face 501 can be reduced.

Here, in the case of using a liquid absorber as the liquid retaining portion in place of the container recessed portions 532 and 532P, the liquid absorber (first liquid absorber) in the liquid container 50K is configured to be able to absorb more ink than a liquid absorber (second liquid absorber) in each of the liquid containers 50C, 50M, and 50Y does. For example, in the case of using liquid absorbers of the same material, the first liquid absorber has a larger volume than the volume of each second liquid absorber. The liquid retaining capability of the first liquid absorber may be made higher than the liquid retaining capability of each second liquid absorber by selecting materials such that the amount of liquid to be retained per unit volume of the first liquid absorber is larger than that of each second liquid absorber.

Figure 20:
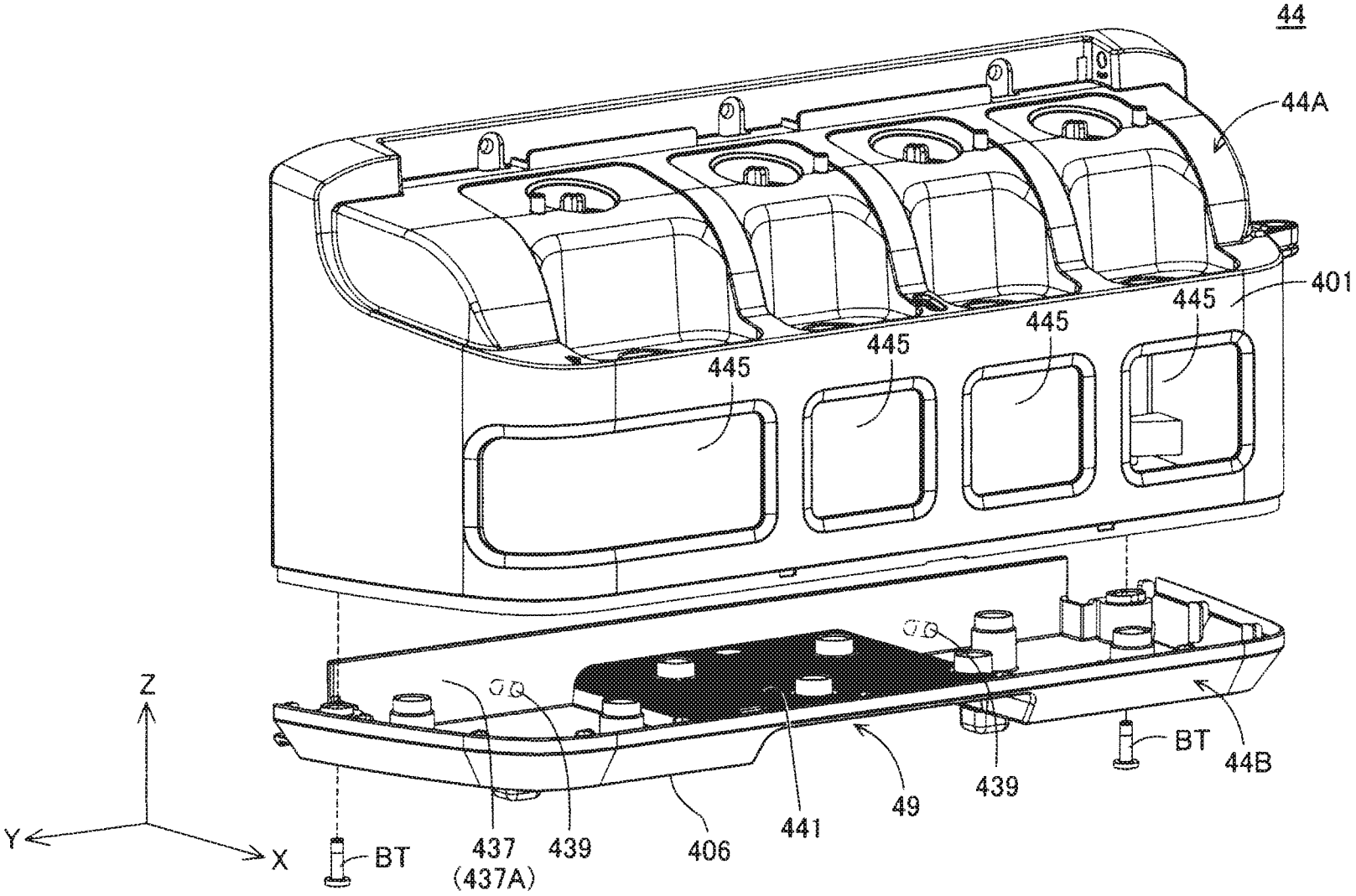
FIG. 20 is an exploded perspective view of a case body.

A-4. Detailed Configuration of Case 40:

FIG. 20 is an exploded perspective view of the case body 44. FIG. 21 is a perspective outline view of the lower case 44B. As shown in FIG. 20, the upper case 44A and the lower case 44B are attached to each other by attachment members BT such as screws. Note that in another embodiment, the upper case 44A and the lower case 44B may be integrally provided by means of integral molding or the like.

The lower case 44B has a first case recessed portion 434A, a second case recessed portion 434B, and a case guiding path forming portion 441.

The first and second case recessed portions 434A and 434B (FIG. 21) are located within the case 40, and are open on the side on which the liquid container 50 is located (the side in the +Z-axis direction). The first and second case recessed portions 434A and 434B are arranged with the case guiding path forming portion 441 therebetween in the Y-axis direction (arranging direction of the liquid containers 50). When referring to the first and second case recessed portions 434A and 434B without distinction, these case recessed portions will be referred to as "case recessed portions 434".

The case recessed portions 434 each have a bottom face 435 of the case recessed portion 434, and a case recessed portion forming wall 437 that demarcates and forms a recessed shape which is erected from a peripheral portion of the bottom face 435. The case recessed portions 434 can store a predetermined amount of ink. The case recessed portions 434 are in communication with the container guiding paths 530 and 530P (FIGS. 4 and 13). For example, the case recessed portions 434 may be in communication with the container guiding paths 530 and 530P by being directly connected thereto, or may be in communication therewith via other flow paths. In this embodiment, for example, the ink that has passed through the container guiding path 530 flows on the connection face 507 in the vertically downward direction (FIG. 4). The ink that has dropped off from the connection face 507 reaches the case recessed portions 434. For example, the ink that has reached a downstream end (lower portion of the fourth face 504) of the container guiding path 530P reaches the case recessed portion 434 directly or via the case guiding path forming portion 441.

The case recessed portion forming wall 437 has an opposing wall 437A that opposes the housing 12. The opposing wall 437A is a part of the second face 402 (FIG. 2) of the case 40. A connecting hole portion 439, to which an end portion of the communication path 77 (FIG. 1) is connected, is formed in the opposing wall 437A. The connecting hole portion 439 has a tubular shape that projects outward of the case 40 from the opposing wall 437A. The case recessed portion 434 and the waste liquid storing portion 76 (FIG. 1) are in communication with each other via the connecting hole portion 439 and the communication path 77. If a predetermined amount of the ink or more is stored in the case recessed portion 434, the ink in the case recessed portion 434 flows toward the waste ink storing portion 76 (FIG. 1) via the connecting hole portion 439 and the communication path 77. Note that a pump may be provided in the middle of the route of the communication path 77, and the ink existing in the case recessed portion 434 may be caused to flow toward the waste liquid storing portion 76. A porous member (liquid absorbing member) such as a sponge may be arranged in the bottom face 435 of the case recessed portion 434. This configuration can further reduce the possibility of an outflow of the ink to the outside of the case 40 from the case recessed portion 434. As described above, it can also be said that the container guiding paths 530 and 530P (FIGS. 4 and 13) are guiding paths that are in communication with the waste liquid storing portion 76 via other members (case recessed portion 434, communication paths 77), and guide the ink existing in the injection port forming faces 520 in a direction different from the direction toward the visual check face 501. These guiding paths can reduce the possibility that the ink existing in the injection port forming faces 520 reaches the visual check faces 501. The ink in the guiding paths can also be caused to flow toward the waste liquid storing portion 76 of the printer 10.

The case guiding path forming portion 441 (FIG. 21) is located within the case 40. The case guiding path forming portion 441 is located at a position that is higher than the bottom face 435 of the case recessed portion 434 when in the use state and the injection state of the liquid container unit 30. The case guiding path forming portion 441 is a face. Groove-shaped case guiding paths 449 are formed in the case guiding path forming portion 441 that is a face. The case guiding paths 449 are flow paths for guiding the ink existing in the case guiding path forming portion 441 to the case recessed portions 434. The case guiding paths 449 extend in the Y-axis direction (arranging direction of the liquid containers 50). The case guiding paths 449 extend from the first case recessed portion 434A up to the second case recessed portion 434B.

The bottom face 435 and the case guiding paths 449 in the lower case 44B (FIG. 21) are formed by a plate-shaped bottom face forming member 700. The bottom face forming member 700 is also called a "case guiding path forming wall 700". A face of the bottom face forming member 700 on the side opposite to the bottom face 435 is the sixth face 406. When in the use state of the liquid container unit 30 and in the injection state of the liquid container unit 30, the sixth face 406 is arranged so as to face the installation surface. That is to say, the lower case 44B is arranged such that the bottom face 435 is located on the lower side in the vertical direction when in the use state of the liquid container unit 30 and in the injection state of the liquid container unit 30. In this embodiment, the sixth face 406 comes into contact with the installation surface when in the use state of the liquid container unit 30 and in the injection state of the liquid container unit 30.

The lower case 44B (FIG. 21) has a plurality of first protrusions 425AK, 425AC, 425AM, and 425AY that project from the bottom face 435, and a plurality of second protrusions 425BK, 425BC, 425BM, and 425BY that project from the bottom face 435. Here, two protrusions, namely the protrusions 425AK and 425BK correspond to the liquid container 50K and are located immediately under the liquid container 50K. Two protrusions, namely the protrusions 425AC and 425BC correspond to the liquid container 50C and are located immediately under the liquid container 50C. Two protrusions, namely the protrusions 425AM and 425BM correspond to the liquid container 50M and are located immediately under the liquid container 50M. Two protrusions, namely the protrusions 425AY and 425BY correspond to the liquid container 50Y and are located immediately under the liquid container 50Y. Here, when referring to the first protrusions 425AK, 425AC, 425AM, and 425AY without distinction, a reference numeral "425A" will be used. When referring to the second protrusions 425BK, 425BC, 425BM, and 425BY without distinction, a reference numeral "425B" will be used. A tip of each first protrusion 425A on the side in the +Z-axis direction and a tip of each second protrusion 425B on the side in the +Z-axis direction are arranged at positions higher than the case recessed portion 434 and the case guiding path forming portion 441 (positions on the side in the +Z-axis direction).

The first protrusions 425A and the second protrusions 425B each have a tubular structure that is open on the side in the vertically upward direction. The first protrusions 425A and the second protrusions 425B are arranged on the side (side in the −Z-axis direction) opposing the liquid injection port 52 (FIG. 2) and the plug member arrangement portion 491 (FIG. 2) with the liquid containing portion 51 therebetween. A part of each liquid container 50 enters the inside of the corresponding first protrusion 425A and second protrusion 425B. Here, in a state where external force is not applied to each liquid container 50, a bottom portion of the corresponding first protrusion 425A having a tubular structure and a bottom portion of the corresponding second protrusion 425B having a tubular structure are arranged with a gap from the part of the liquid containing portion 50 that enters the first and second protrusions 425A and 425B. On the other hand, when each plug member 200 is attached to the corresponding liquid injection port 52 or when each plug member 200 is arranged in the corresponding plug member arrangement portion 491, there are cases where external force exerted in the vertically downward direction is applied to the corresponding liquid container 50 or the periphery of a portion of the upper case 44A where the plug member arrangement portion 491 is arranged. In such cases, the liquid container 50 undergoes deformation to the side in the −Z-axis direction in some cases. When the liquid container 50 undergoes deformation to the side in the −Z-axis direction, the bottom portions of the first protrusion 425A and the second protrusion 425B come into contact with a part of the liquid container 50, thereby supporting the liquid container 50.

The lower case 44B (FIG. 20) further includes a holding portion 49 that is provided in a face (sixth face 406) on the side opposing the case guiding path forming portion 441 (outer surface side of the case 40). The holding portion 49 is a recessed portion. The holding portion 49 extends from the opposing wall 437A up to the first face 401 side of the case 40. That is to say, the holding portion 49 is open on the first face 401 (side in the +X-axis direction) side in addition to the side opposing the bottom face of the recessed shape (side in the −Z-axis direction). The opening of the holding portion 49 on the side in the +X-axis direction has a size that enables a human hand to be inserted in the holding portion 49. When the liquid consuming system 1 that includes the printer 10 and the liquid container unit 30 is carried, a hand can be inserted in the holding portion 49 from the opening of the holding portion 49 on the side in the +X-axis direction to hold the holding portion 49.

Figure 22:
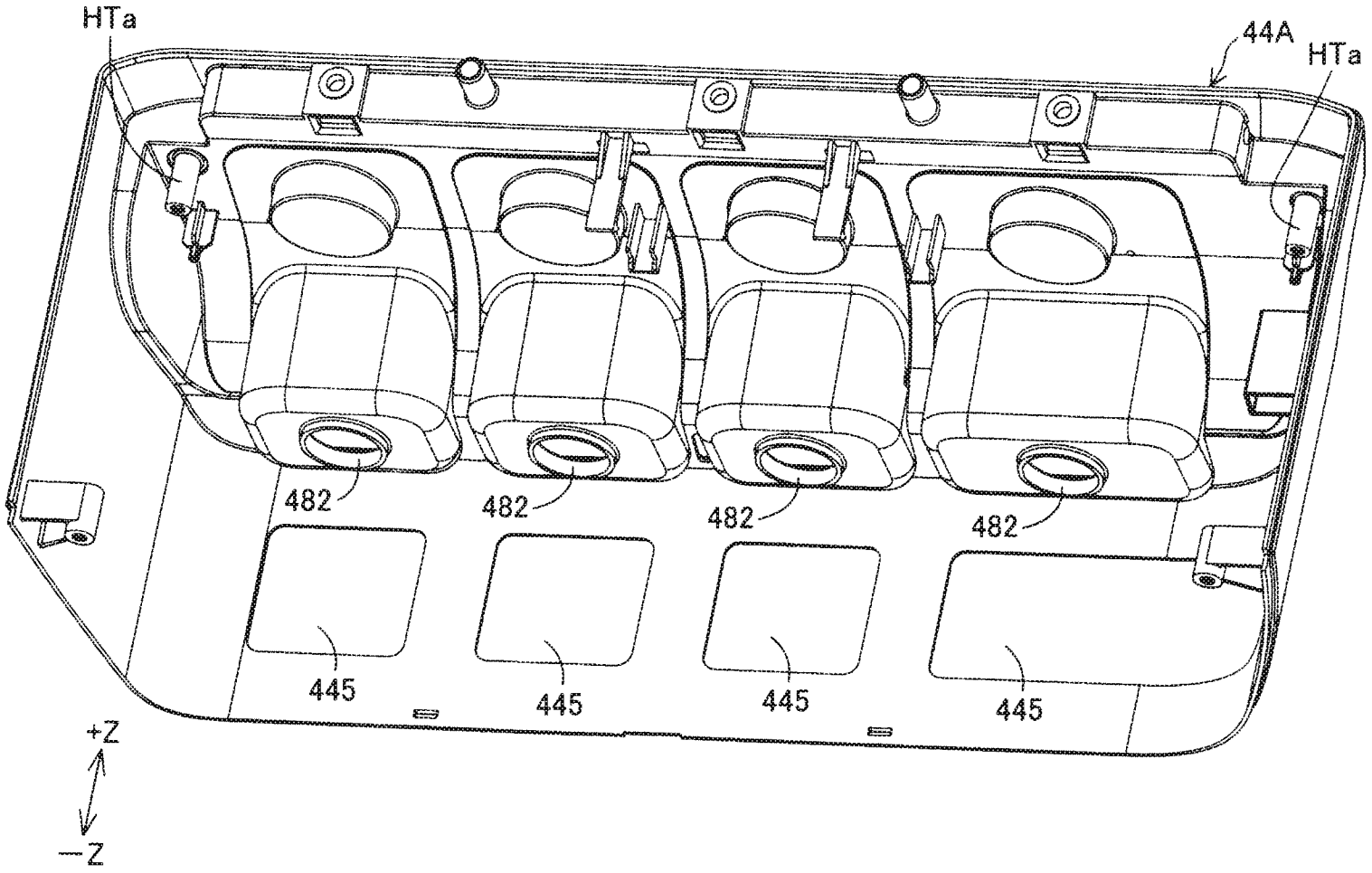
FIG. 22 is a perspective external view of an upper case.
Figure 23:
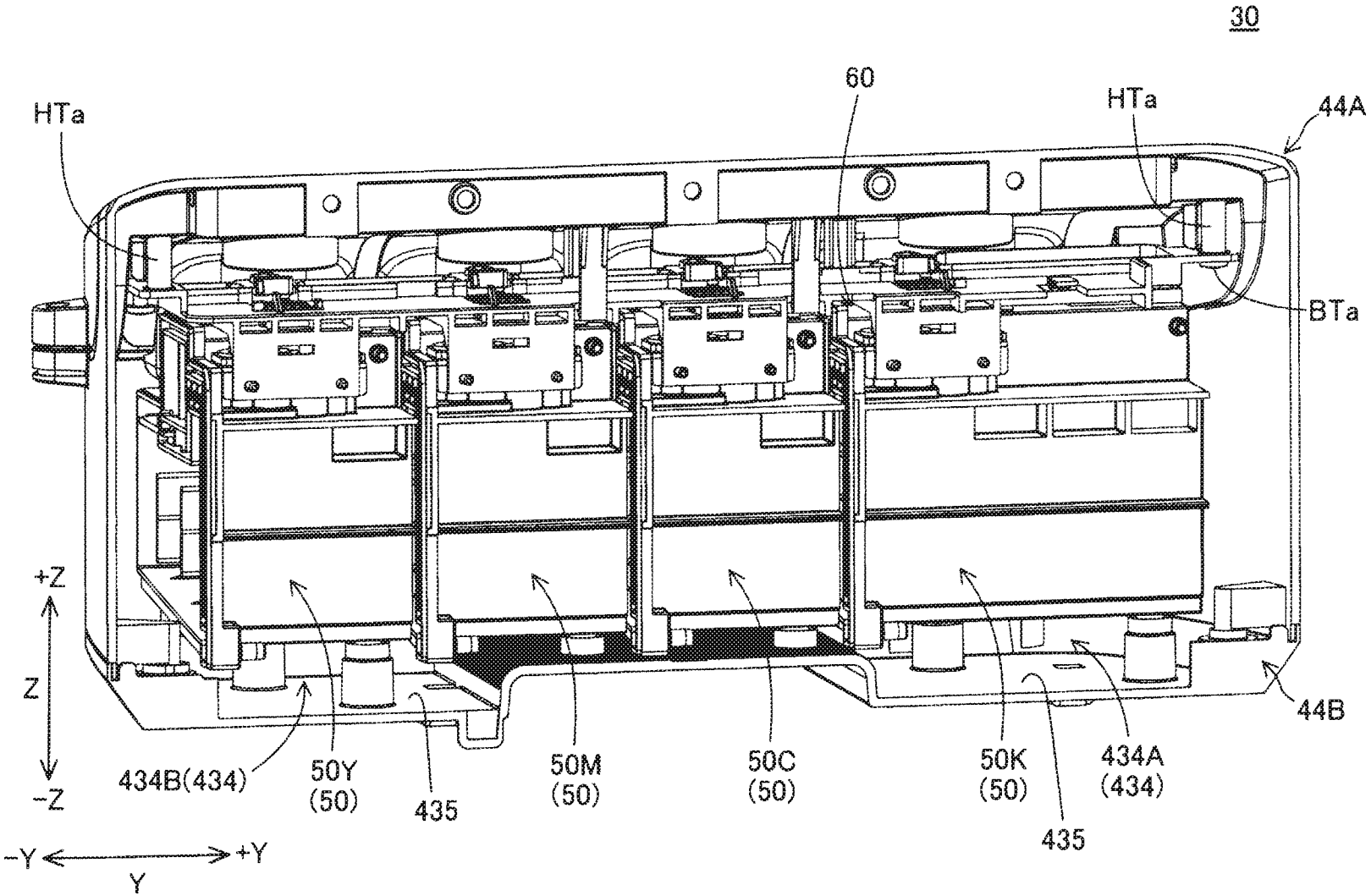
FIG. 23 is a diagram showing the liquid container unit as viewed from the back side.
Figure 24:
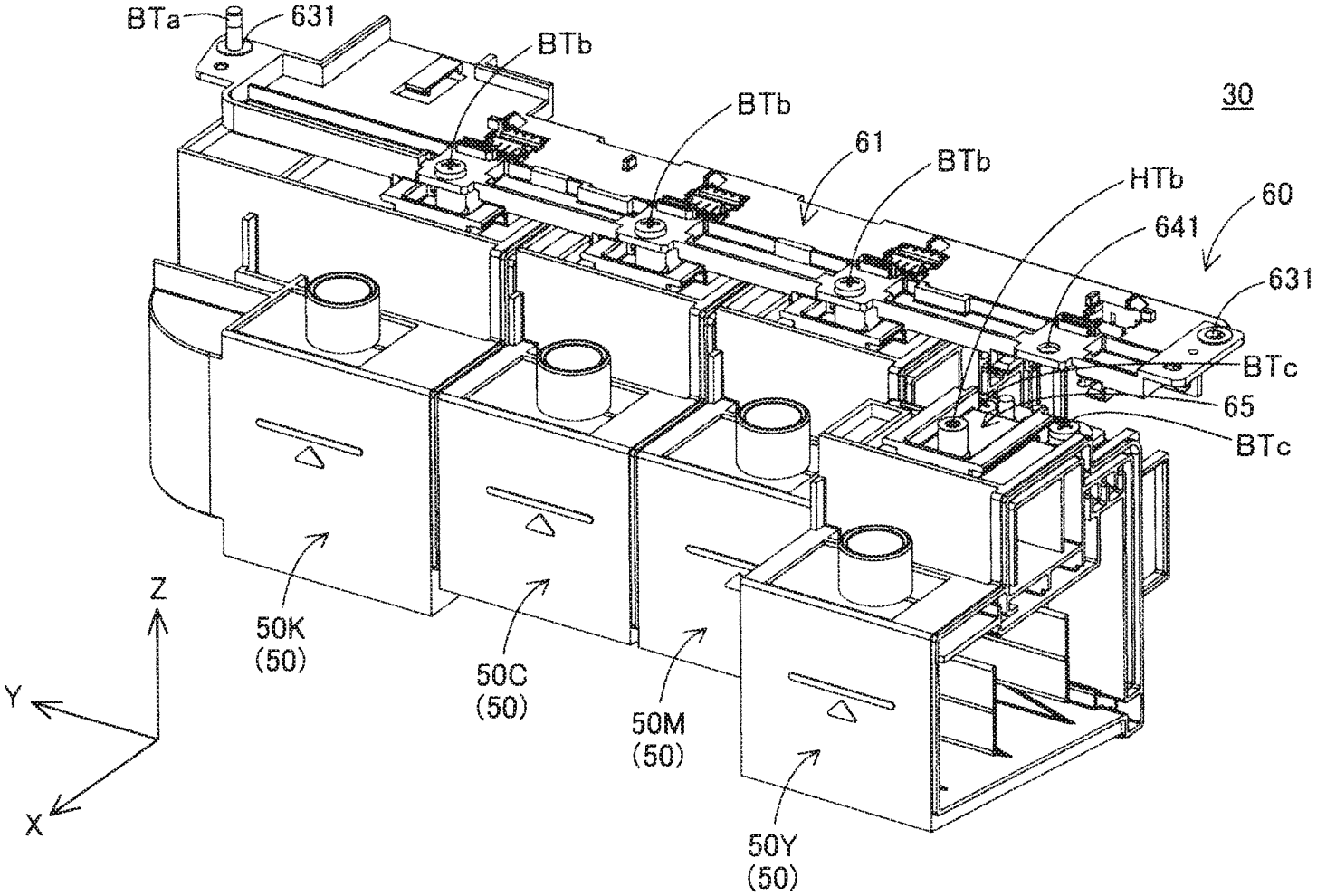
FIG. 24 is a diagram for illustrating an attachment mechanism.

FIG. 22 is a perspective external view of the upper case 44A. FIG. 23 is a diagram of the liquid container unit 30 as viewed from the back side. FIG. 24 is a diagram for illustrating an attachment mechanism 60. In FIG. 23, the liquid container unit 30 is cut out in a cross-section parallel with the Y-axis direction and the Z-axis direction in order to simplify the description.

As shown in FIG. 22, the upper case 44A has insertion holes 482 in which the liquid injection ports 52 are inserted. A part of each liquid injection port 52 inserted in the corresponding insertion hole 482 is located outside the upper case 44A (FIG. 2). The upper case 44A is provided with a plurality of insertion holes 482 in which the plurality of liquid injection ports 52 are inserted, and a plurality of visual check portions 445 that are openings. The upper case 44A is a case that is created by integrally forming the upper face provided with the insertion holes 482 and three side faces including the side face in which the openings serving as the visual check portions 445 are provided. A lower face of the upper case 44A is open. Specifically, an opening is formed in the lower face of the upper case 44A. Accordingly, the upper case 44A has a structure with which the liquid injection ports 52 can be easily inserted in the insertion holes 482 and that can be easily manufactured. The side face (second face) 402 of the upper case 44A on the side opposing the printer 10 is also open. Accordingly, the upper case 44A need only be integrated with the case of the printer 10 after attaching the liquid containers 50, a remaining liquid amount sensor, wirings thereof (not shown), or the like to the upper case 44A, which facilitates manufacturing. Note that the upper case 44A may be integrally formed with the case of the printer 10. In this case, the manufacturing is further facilitated.

As shown in FIG. 23, the liquid containers 50 are fixed to the upper case 44A by the attachment mechanism 60. As shown in FIG. 24, the attachment mechanism 60 has a first attachment portion 61, second attachment portions 65, and screws BTa, BTb, and BTc, which serve as attachment tools. The first attachment portion 61 is a single-plate shape. Insertion holes 631 are provided at both end portions of the first attachment portion 61 in the Y-axis direction. Two screws BTa (only one is shown in the diagram) are each inserted into the corresponding insertion hole 631 and screwed with an attachment hole HTa (FIG. 22) formed on the upper case 44A. The first attachment portion 61 is thus fixed to the upper case 44A. As shown in FIG. 24, four second attachment portions 65 are provided so as to correspond to the four liquid containers 50C, 50M, 50Y, and 50K. Each second attachment portion 65 is fixed to the corresponding liquid container 50 as a result of the corresponding screw BTc being provided in the second attachment portion 65, inserted in an insertion hole (not shown), and screwed with the attachment hole HTc (FIG. 3). Each second attachment portion 65 has an attachment hole HTb. Each second attachment portion 65 is fixed to the first attachment portion 61 as a result of the corresponding screw BTb being inserted in an insertion hole 641 provided in the first attachment portion 61 and screwed with the attachment hole HTb. In the above-described manner, the liquid containers 50 are fixed to the upper case 44A, which is located above the lower case 44B, by the attachment mechanism 60. In this embodiment, the liquid containers 50 are not fixed to the lower case 44B and are arranged with a gap from the bottom face 435 of the case recessed portion 434. Accordingly, the lower case 44B can be easily removed, and the ink stored in the case recessed portion 434 can be easily disposed by removing the lower case 44B.

According to the above embodiment, each liquid container 50 has the projecting portion 522, 522P that serves as a suppressing portion for suppressing a flow of the ink existing in the container guiding path 530, 530P toward the visual check face 501, as shown in FIGS. 4 and 13. With this configuration, the possibility that the ink reaches the visual check face 501 can be reduced by the projecting portion 522, 522P even if the ink that has flowed out from the container guiding path 530, 530P flows toward the visual check face 501. Thus, the possibility of attachment of the ink to the visual check face 501 can be reduced.

According to the above embodiment, as shown in FIGS. 4 and 13, the projecting portion 522, 522P projects in a direction parallel with the visual check face from a portion of the side wall 510 in which the opening portion 511 is formed between a portion in which the opening portion 511 is formed and the side portion 510X in which the visual check face 501 is located. With this configuration, the possibility that the ink reaches the visual check face 501 can be reduced by the projecting portion 522, 522P even if the ink has flowed through the opening portion 511 flows toward the visual check face 501.

According to the above embodiment, the projecting portion 522, 522P constitutes a part of the container guiding path 530, 530P, as shown in FIGS. 4 and 13. With this configuration, a member for configuring the container guiding path 530, 530P and a member for configuring the suppressing portion can be formed using a common member.

According to the above embodiment, the projecting portion 522P is a face on the side opposite to the visual check face 501 in the visual check face forming wall 501C, as shown in FIGS. 13 and 19. With this configuration, the projecting portion 522P and the visual check face 501 do not need to be formed by different walls.

According to the above embodiment, the lower case 44B includes the case recessed portion 434 capable of storing ink, and the case guiding path forming portion 441 for guiding the ink to the case recessed portion 434, as shown in FIG. 21. With this configuration, the ink that has flowed into the lower case 44B can be guided to the case recessed portion 434 by the case guiding path forming portion 441. Accordingly, the possibility that the ink existing in the lower case 44B leaks around the case 40 can be reduced.

According to the above embodiment, the container guiding path 530, 530P is in communication with the case recessed portion 434, as shown in FIGS. 4, 13, and 23. With this configuration, the ink in the container guiding path 530, 530 can be caused to flow toward the case recessed portion 434.

According to the above embodiment, the case guiding path forming wall 700 has the holding portion 49 that is formed in a portion on the side opposite to the case guiding path forming portion 441 and can be held, as shown in FIG. 20. With this configuration, the case guiding path forming portion 411 and the holding portion 49 can be formed using the case guiding path forming wall 700.

According to the above embodiment, the liquid container 50 is fixed to the upper case 44A without being fixed to the lower case 44B, as shown in FIGS. 23 and 24. With this configuration, a maintenance operation for the lower case 44B, such as treatment of the ink stored in the case recessed portion 434, can be easily performed by removing the lower case 44B from the upper case 44A.

According to the above embodiment, the lower case 44B is arranged such that the face (sixth face) 406 of the case recessed portion 434 on the side opposite to the bottom face 435 comes into contact with the installation surface when in the use state and the injection state of the liquid container unit 30. With this configuration, the bottom face 435 is not in an erected state when in the use state and the injection state, and it is accordingly possible to reduce the possibility of an outflow of the ink stored in the case recessed portion 434 to the visual check face 501 or to the outside of the liquid container unit 30.

According to the above embodiment, the case recessed portion 434 is in communication with a waste liquid storing portion 76. With this configuration, it is possible to reduce the possibility of the overflow of the ink that has flowed to the case recessed portion 434 to the periphery.

B. Second Embodiment

Figure 25:
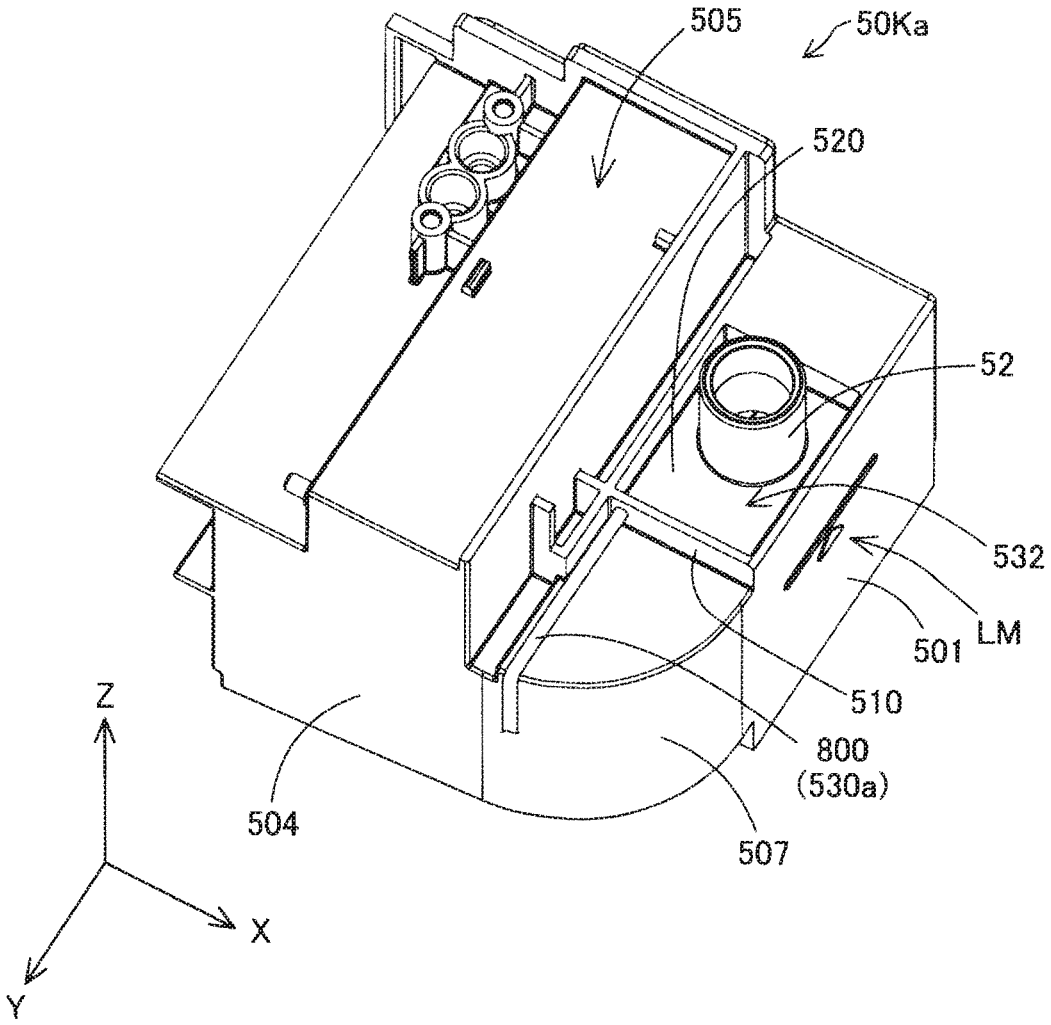
FIG. 25 is a diagram for illustrating a liquid container that serves as a second embodiment of the invention.
Figure 26:
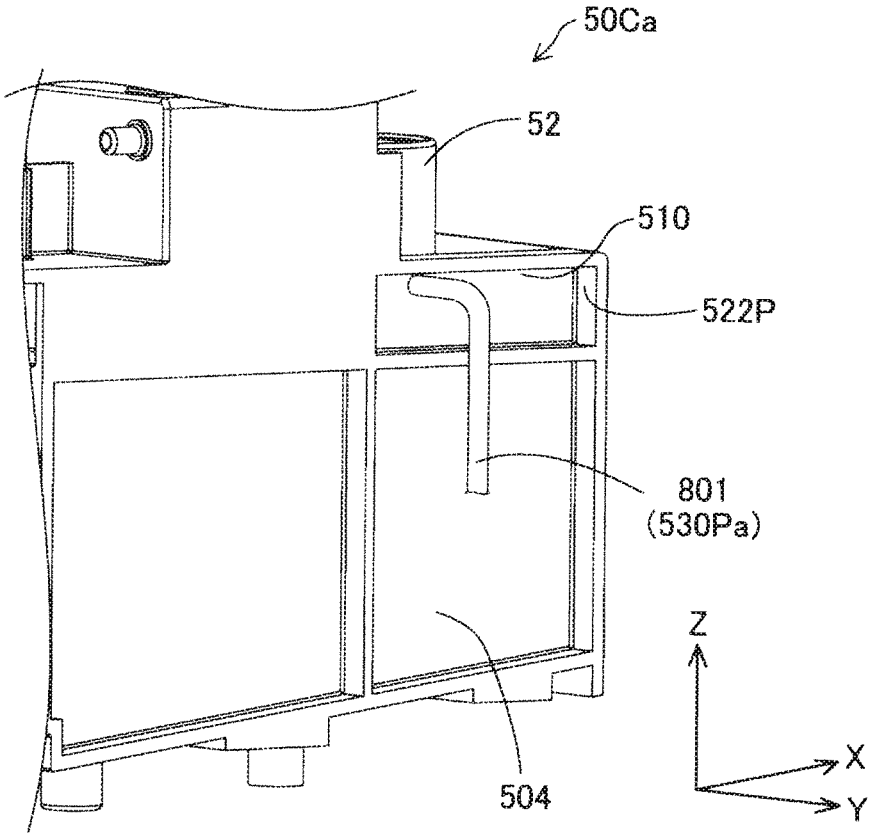
FIG. 26 is a diagram for illustrating a liquid container that serves as the second embodiment of the invention.

FIG. 25 is a diagram for illustrating a liquid container 50Ka that serves as a second embodiment of the invention. FIG. 26 is a diagram for illustrating a liquid container 50Ca that serves as the second embodiment of the invention. A difference between the liquid container 50K (FIG. 4) according to the first embodiment and the liquid container 50Ka (FIG. 25) according to the second embodiment lies in a configuration of a container guiding path 530*a*, and in that the liquid container 50Ka does not have the projecting portion 522 (FIG. 4) serving as the suppressing portion. A difference between the liquid container 50C (FIG. 13) according to the first embodiment and the liquid container 50Ca (FIG. 26) according to the second embodiment lies in a configuration of a container guiding path 530P. Since other configurations are similar to those in the first embodiment, the similar configurations will be assigned the same reference numerals, and descriptions thereof will be omitted. The liquid container 50Ca that contains cyan ink has a configuration similar to those of liquid containers that contain magenta and yellow ink. Accordingly, the liquid container 50Ca will be described here. The liquid containers 50Ka and 50Ca according to the second embodiment are contained in the case 40 (FIG. 1) as in the first embodiment, and are used as constituent members of the liquid consuming system 1.

As shown in FIG. 25, the liquid container 50Ka has a tube 800 whose one end portion is connected to the opening portion 511 (FIG. 4). The other end portion of the tube 800 is located in the case recessed portion 434 of the lower case 44B. As shown in FIG. 26, the liquid container 50Ca has a tube 801 whose one end portion is connected to the opening portion 511 (FIG. 13). The other end portion of the tube 801 is located in the case recessed portion 434 of the lower case 44B. Note that the other end portions of the tubes 800 and 801 may be connected to the waste liquid storing portion 76. The tubes 800 and 801 constitute a part of container guiding paths 530*a* and 530Pa, respectively. The container guiding paths 530*a* and 530Pa can guide ink existing in the injection port forming face 520 in directions (+Y-axis direction and −Z-axis direction) different from the direction (+X-axis direction) toward the visual check faces 501, as in the above-described first embodiment.

C. Modifications

Note that this invention is not limited to the above examples and embodiment, and may be implemented in various modes without departing from the gist of the invention. For example, the following modifications are also possible.

C-1. First Modification

In the above embodiment, the suppressing portion 522, 522P is formed by a member that projects from the side wall 510 (FIGS. 4 and 12). However, the suppressing portion is not limited thereto, and need only be a member capable of suppressing a flow of the ink existing in the container guiding path 530, 530*a* toward the visual check faces 501. For example, a porous member such as a sponge may be arranged in a route from the opening portion 511 to the visual check face 501 (e.g., the connecting face 507 in FIG. 4 and the fourth face 504 in FIG. 12), or a groove capable of retaining liquid may be provided therein. Alternatively, the suppressing portion may be configured by combining a projecting member, a porous member, and a groove.

C-2. Second Modification

The projecting portion 522 (FIG. 4) of the liquid container 50K may also be provided in the connecting face 507. Specifically, a projecting portion that extends from an upper part up to a lower part of the connecting face 507 may be provided so as to be continuous with the projecting portion 522 formed in the fifth face 505. This configuration can further reduce the possibility that the ink flowing through the container guiding path 530 reaches the visual check face 501.

C-3. Third Modification

In the above embodiment, the liquid containers 50 are fixed to the upper case 44A by the attachment mechanism 60, as shown in FIGS. 23 and 24. However, the liquid containers 50 may be directly fixed to the upper case 44A by a screw or the like, or may be fixed to the lower case 44B.

C-4. Fourth Modification

In the above embodiment, the liquid container unit 30 or the liquid container 50 are arranged outside the housing 12, but may be arranged within the housing 12. In this case, the housing 12 may be configured such that a part of the housing 12 can be opened and closed so as to allow operations to the liquid container 50, such as an operation of injecting the ink to the liquid container 50, to be performed from the outside.

C-5. Fifth Modification

The invention can also be achieved in the following mode. Note that numbers in brackets correspond to the reference numerals in the above embodiment.

[Mode 1] A liquid container (50) having a liquid containing portion (51) capable of containing liquid to be supplied to a liquid consuming apparatus (10), and a liquid injection port (52) for injecting the liquid to the liquid containing portion (51), including:

an injection port forming face (520) that serves as a bottom face of a container recessed portion (532) which is open in a vertically upward direction when in a first state of the liquid container (50) where the liquid injection port (52) is open in the vertically upward direction (+Z-axis direction), the liquid injection port (52) being arranged in the container recessed portion (532); and a visual check face (501) that intersects the injection port forming face (520) and through which a liquid surface in the liquid containing portion (51) can be visually checked from the outside, the visual check face (501) having a portion (501B) located below the injection port forming face (520) when in the first state;

a container guiding path (530) that guides the liquid existing within the container recessed portion (532) in a direction (+Y-axis direction) different from a direction (+X-axis direction) toward the visual check face (501); and a suppressing portion (522, 522P) that suppresses a flow of the liquid existing in the container guiding path (530) toward the visual check face (501).

According to this mode, even if the liquid that has flowed out from the container guiding path flows toward the visual check face, the possibility that the liquid reaches the visual check face can be reduced by the suppressing portion. This configuration can reduce the possibility of attachment of the liquid to the visual check face.

[Mode 2] The liquid container (50) according to Mode 1, wherein the container recessed portion (532) has a recessed portion forming wall (501A, 510, 517, 518) that is erected from the injection port forming face (520) and demarcates and forms a recessed shape, and the container guiding path (530) includes an opening portion (511) formed in the recessed portion forming wall (501A, 510, 517, 518), an opening direction (+Y-axis direction) in which the opening portion (511) is open to the outside from the inside of the container recessed portion (532) being different from a direction (+X-axis direction) toward the visual check face (501).

According to this mode, the liquid within the container recessed portion can be easily guided in a direction different from the direction toward the visual check face by the opening portion.

[Mode 3] The liquid container (50) according to Mode 2, wherein a part of the recessed portion forming wall (501A, 510, 517, 518) is formed by a visual check face forming wall (501A) that forms the visual check face (501), and the opening portion (511) is formed in a wall (510) different from the visual check face forming wall (501A) in the recessed portion forming wall (501A, 510, 517, 518).

According to this mode, the liquid in the container recessed portion can be easily guided in a direction different from the direction toward the visual check face by the opening portion.

[Mode 4] The liquid container (50) according to Mode 2 or Mode 3, wherein the recessed portion forming wall (501A, 510, 517, 518) has an opening portion forming wall (510) in which the opening portion (511) is formed, the opening portion forming wall (510) intersecting the visual check face (501), and the suppressing portion (522, 522P) includes a projecting portion (522) projecting from a position between a portion of the opening portion forming wall (510) in which the opening portion (511) is formed and a side portion (510X) in which the visual check face (501) is located.

According to this mode, the liquid in the container recessed portion can be easily guided in a direction different from the direction toward the visual check face by the opening portion.

C-6. Sixth Modification

In the above embodiment, the liquid container unit 30 has the liquid container 50 for supplying ink to the printer 10, and the case 40 for housing the liquid container 50. However, the invention may be applied to liquid containers which contain other kinds of liquid and liquid consuming apparatuses that consume other kinds of liquid. Liquid consuming apparatuses that use liquid containers that contain other kinds of liquid are listed below.

(1) Image recording apparatuses such as a facsimile apparatus (2) Color material ejection recording apparatuses used to manufacture color filters for image display apparatuses such as a liquid crystal display (3) Electrode material ejection apparatuses used to form electrodes for organic EL (Electro Luminescence) displays, field emission displays (FED), or the like (4) Liquid consuming apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid consuming apparatuses that perform pinpoint ejection of lubricating oil to precision machines such as a watch and a camera (9) Liquid consuming apparatuses that eject transparent resin solution such as UV-cured resin solution onto substrates in order to form micro-hem hemispherical lenses (optical lenses) or the like used in optical communication elements or the like

(10) Liquid consuming apparatuses that eject acid or alkaline etchant in order to etch substrates or the like

(11) Liquid consuming apparatuses that include liquid consumption heads for discharging a very small amount of any other kinds of droplet Note that the "droplet" refers to a state of the liquid discharged from liquid consuming recording apparatuses or liquid consuming apparatuses, and includes droplets having a granular shape, a tear-drop shape, and a shape with a thread-like trailing end. The "Liquid" mentioned here need only be a material, the liquid state of which can be ejected by liquid consuming recording apparatuses or liquid consuming apparatuses. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink. When UV ink that can be cured by irradiating the UV ink with ultraviolet rays is contained in this liquid containing portion and the liquid containing portion is connected to a printer, a liquid containing bag is separate from the installation surface, and accordingly, the possibility that heat on the installation surface is transmitted to the liquid containing portion and cures the UV ink is reduced.

C-7. Seventh Modification

The invention is not limited to the above embodiment and modifications, and can be achieved by various configurations without departing from the gist thereof. For example, the technical features in the embodiment and modifications that correspond to the technical features in the modes described in the summary of the invention can be replaced or combined as appropriate in order to solve some or all of the problems described above, or in order to achieve some or all of the above-described effects. A technical feature that is not described as essential in the specification can be deleted as appropriate.

What is claimed is:

1. A liquid container comprising:

a liquid containing portion configured to contain liquid to be supplied to a liquid consuming apparatus;

a liquid injection port for injecting the liquid to the liquid containing portion;

a liquid retaining portion having an injection port forming face that extends in a lateral direction and faces outside the liquid containing portion, and through which the liquid injection port extends, the liquid retaining portion configured to retain liquid on the injection port forming face;

a visual check face that intersects the injection port forming face and is configured such that a liquid surface in the liquid containing portion can be visually checked from the outside; and a container guiding path configured to guide liquid disposed on the injection port forming face to the outside of the liquid containing portion and in a direction different from a direction toward the visual check face.

2. The liquid container according to claim 1, further comprising:

a suppressing portion configured to suppress a flow of the liquid disposed on the container guiding path toward the visual check face.

3. The liquid container according to claim 2, further comprising:

a side wall that intersects the injection port forming face and the visual check face, wherein the container guiding path includes an opening portion formed in the side wall, and the suppressing portion includes a projecting portion that projects in a direction having a direction component parallel with the visual check face from a position between a portion of the side wall in which the opening portion is formed and a side portion in which the visual check face is located.

4. The liquid container according to claim 3, wherein the projecting portion constitutes at least a part of the container guiding path.

5. The liquid container according to claim 3, further comprising:

a visual check face forming wall that includes or defines the visual check face, wherein the projecting portion is a face of the visual check face forming wall on a side opposite to the visual check face.

6. The liquid container according to claim 2, further comprising:

a side wall that intersects the injection port forming face and the visual check face, wherein the container guiding path includes an opening portion formed in the side wall, and the suppressing portion includes a projecting portion that projects between a portion of the side wall in which the opening portion is formed and a side portion in which the visual check face is located.

7. The liquid container according to claim 6, wherein the suppressing portion extends to one end of the injection port forming face at which the injection port forming face intersects with a face that intersects with the visual check face.

8. A liquid container unit comprising:

a liquid container having a liquid containing portion configured to contain liquid to be supplied to a liquid consuming apparatus, and a liquid injection port for injecting the liquid to the liquid containing portion; and a case configured to house the liquid container, wherein the case includes a lower case, and the lower case includes:

a case recessed portion located within the case and open on a side on which the liquid container is located, the case recessed portion configured to store the liquid, and a case guiding path forming portion configured to guide the liquid to the case recessed portion, the case guiding path forming portion located within the case and arranged at a position higher than a bottom face of the case recessed portion, and the case guiding path forming portion defining a portion of an inside surface of the lower case.

9. The liquid container unit according to claim 8, wherein the liquid container includes:

a liquid retaining portion configured to retain the liquid, the liquid retaining portion including an injection port forming face through which the liquid injection port extends;

a visual check face that intersects the injection port forming face and is configured such that a liquid surface in the liquid containing portion can be visually checked from the outside; and a container guiding path configured to guide the liquid disposed on the injection port forming face in a direction different from a direction toward the visual check face, and wherein the container guiding path is in communication with the case recessed portion.

10. The liquid container unit according to claim 8, wherein the lower case further has a bottom face forming member that includes or defines the case guiding path forming portion, and the bottom face forming member includes a holding portion disposed opposite to the case guiding path forming portion.

11. The liquid container unit according to claim 8, wherein the case includes an upper case, and the liquid container is fixed to the upper case.

12. The liquid container unit according to claim 8, wherein the lower case has a bottom face forming member that includes or defines the bottom face of the case recessed portion, and the lower case is arranged such that a face of the bottom face forming member on a side opposite to the bottom face of the case recessed portion faces an installation surface when in a use state where the liquid is supplied from the liquid container unit to the liquid consuming apparatus, and in an injection state where the liquid is injected from the liquid injection port to the liquid containing portion.

13. The liquid container unit according to claim 8, wherein the case recessed portion is in communication with a waste liquid storing portion provided in the liquid consuming apparatus, the waste liquid storing portion configured to store the liquid after the liquid is consumed.

14. The liquid container according to claim 8, wherein the case guiding path forming portion defines an upward-facing surface of the lower case.

15. A liquid container comprising:

a liquid containing portion configured to contain liquid to be supplied to a liquid consuming apparatus;

a liquid injection port for injecting the liquid to the liquid containing portion;

a liquid retaining portion configured to retain the liquid, the liquid retaining portion having an injection port forming face through which the liquid injection port extends;

a visual check face that intersects the injection port forming face and is configured such that a liquid surface in the liquid containing portion can be visually checked from the outside; and a guiding path configured to guide the liquid disposed on the injection port forming face in a direction different from a direction toward the visual check face, the guiding path being in communication with a waste liquid storing portion provided in the liquid consuming apparatus.

16. A liquid supply apparatus comprising a plurality of liquid containers configured to contain liquid to be supplied to a liquid consuming apparatus, wherein:

the plurality of liquid containers each include:

a liquid containing portion configured to contain the liquid;

a liquid supply port configured to supply the liquid to the liquid containing portion;

a liquid retaining portion configured to retain the liquid, the liquid retaining portion having a liquid supply port forming face through which the liquid supply port extends; and a visual check face that intersects the liquid supply port forming face configured such that a liquid surface in the liquid containing portion can be visually checked from the outside, one of the plurality of liquid containers includes a liquid containing portion whose volume is larger than a volume of any of the liquid containing portions of the other liquid containers of the plurality of liquid containers, and the liquid retaining portion of the one of the plurality of liquid containers has a higher liquid retaining capability than a liquid retaining capability of the liquid retaining portion of any of the other liquid containers of the plurality of liquid containers.

17. The liquid supply apparatus according to claim 16, wherein the liquid retaining portion includes a recessed portion whose bottom face is the liquid supply port forming face.

18. The liquid supply apparatus according to claim 16, wherein the liquid retaining portion includes a liquid absorber.

19. The liquid supply apparatus according to claim 16, further comprising:

a container guiding path configured to guide the liquid disposed on the liquid supply port forming face in a direction different from a direction toward the visual check face.

* * * * *